US012421953B2

(12) United States Patent
Hurst et al.

(10) Patent No.: US 12,421,953 B2
(45) Date of Patent: Sep. 23, 2025

(54) DIRECT CONNECT PISTON-DRIVEN BELLOWS PUMP

(71) Applicant: Halliburton Energy Services, Inc., Houston, TX (US)

(72) Inventors: Justin Lee Hurst, Duncan, OK (US); Timothy Holiman Hunter, Duncan, OK (US); Andrew Silas Clyburn, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 43 days.

(21) Appl. No.: 18/398,878

(22) Filed: Dec. 28, 2023

(65) Prior Publication Data

US 2024/0376880 A1 Nov. 14, 2024

Related U.S. Application Data

(60) Provisional application No. 63/501,952, filed on May 12, 2023.

(51) Int. Cl.
*F04B 43/107* (2006.01)
*E21B 43/25* (2006.01)
(Continued)

(52) U.S. Cl.
CPC ..... *F04B 43/107* (2013.01); *E21B 43/25* (2013.01); *F04B 23/06* (2013.01); *F04B 45/0333* (2013.01); *F04B 47/04* (2013.01)

(58) Field of Classification Search
CPC ..... F04B 43/00–14
See application file for complete search history.

(56) References Cited

U.S. PATENT DOCUMENTS 1,256,127 A 2/1918 Gould
1,301,485 A 4/1919 Mueller
(Continued)

FOREIGN PATENT DOCUMENTS

CN 201982789 U 9/2011
CN 104763410 A 7/2015
(Continued)

OTHER PUBLICATIONS

Foreign Communication from Related Application—International Search Report and Written Opinion of the International Searching Authority, International Application No. PCT/US2023/086404, dated Apr. 24, 2024, 10 pages.
(Continued)

*Primary Examiner* — Laert Dounis
(74) *Attorney, Agent, or Firm* — Conley Rose, P.C.; Rodney B. Carroll

(57) ABSTRACT

Disclosed embodiments may relate to pumps for introducing treatment fluid into a well. For example, a piston-driven bellows pump may include a power end, having a piston disposed in a power end bore; a fluid end, having a fluid end bore and a chamber in fluid communication with a suction valve and a discharge valve; and an expandable bellows disposed in the chamber and in fluid communication with the fluid end bore. In embodiments, the power end can be configured to reciprocally expand and contract the bellows within the chamber based on movement of fluid by the piston. In embodiments, the power end bore and the fluid end bore may be fluidly coupled to form a unitary, continuous, and/or unbroken pump bore without external piping therebetween and/or without unswept volume therebetween. Related methods are also disclosed.

20 Claims, 16 Drawing Sheets

(51) Int. Cl.

| | |
|---|---|
| ***F04B 23/06*** | (2006.01) |
| ***F04B 45/033*** | (2006.01) |
| ***F04B 47/04*** | (2006.01) |

(56) References Cited

U.S. PATENT DOCUMENTS

| | | | | |
|---|---|---|---|---|
| 1,650,377 | A | 11/1927 | Nixon | |
| 1,832,257 | A * | 11/1931 | Stephens | F04B 43/08 417/339 |
| 2,464,095 | A | 3/1949 | Nies | |
| 2,546,302 | A | 3/1951 | Gehres et al. | |
| 2,613,607 | A | 10/1952 | Sheen et al. | |
| 2,735,369 | A | 2/1956 | Turvey | |
| 2,807,215 | A * | 9/1957 | Hawxhurst | F04B 49/121 417/388 |
| 3,134,508 | A | 5/1964 | Bayer et al. | |
| 3,151,562 | A | 10/1964 | Swartz | |
| 3,192,860 | A | 7/1965 | Hardison | |
| 3,338,170 | A | 8/1967 | Swartz | |
| 3,411,452 | A | 11/1968 | Czarnecki et al. | |
| 3,433,161 | A | 3/1969 | Vetter | |
| 3,524,714 | A | 8/1970 | Grove et al. | |
| 3,680,981 | A | 8/1972 | Wagner | |
| RE29,055 | E | 11/1976 | Wagner | |
| 4,003,679 | A | 1/1977 | McManigill | |
| 4,080,107 | A | 3/1978 | Ferrentino | |
| 4,406,595 | A | 9/1983 | Robertson et al. | |
| 4,439,112 | A | 3/1984 | Kitsnik | |
| 4,594,057 | A | 6/1986 | Morgan | |
| 4,948,349 | A | 8/1990 | Koiwa | |
| 5,220,943 | A | 6/1993 | Zink | |
| 5,246,351 | A | 9/1993 | Horn et al. | |
| 5,249,932 | A | 10/1993 | Van Bork | |
| 5,308,230 | A | 5/1994 | Moore | |
| 6,419,462 | B1 | 7/2002 | Horie et al. | |
| 6,554,578 | B1 | 4/2003 | Siegel | |
| 9,243,413 | B2 | 1/2016 | Robol et al. | |
| 9,518,577 | B2 | 12/2016 | van Boeyen et al. | |
| 10,408,204 | B2 | 9/2019 | Suzuki | |
| 10,408,207 | B2 | 9/2019 | Yamada et al. | |
| 10,480,296 | B2 | 11/2019 | Beisel | |
| 10,895,254 | B2 | 1/2021 | Beisel | |
| 10,947,967 | B1 | 3/2021 | Surjaatmadja et al. | |
| 11,125,225 | B2 | 9/2021 | Beisel | |
| 11,268,502 | B2 | 3/2022 | Mollatt | |
| 11,286,920 | B2 | 3/2022 | Mollatt | |
| 11,346,336 | B2 | 5/2022 | Surjaatmadja et al. | |
| 11,401,792 | B2 | 8/2022 | Mollatt | |
| 11,415,123 | B2 | 8/2022 | Hunter et al. | |
| 2003/0031565 | A1 | 2/2003 | Kleibrink | |
| 2006/0008364 | A1 * | 1/2006 | Traylor | F04B 43/107 417/390 |
| 2007/0065305 | A1 | 3/2007 | Budde et al. | |
| 2007/0074872 | A1 | 4/2007 | Du et al. | |
| 2008/0145248 | A1 | 6/2008 | Kato et al. | |
| 2009/0041588 | A1 | 2/2009 | Hunter et al. | |
| 2012/0091165 | A1 | 4/2012 | Cedrone et al. | |
| 2012/0308409 | A1 | 12/2012 | Levine | |
| 2015/0148919 | A1 | 5/2015 | Watson | |
| 2016/0097384 | A1 | 4/2016 | Menjoh et al. | |
| 2016/0123313 | A1 * | 5/2016 | Simmons | F04B 9/133 417/392 |
| 2018/0313196 | A1 | 11/2018 | Frantz, III et al. | |
| 2019/0383279 | A1 | 12/2019 | Simmons et al. | |
| 2020/0217186 | A1 | 7/2020 | Mollatt | |
| 2020/0256333 | A1 | 8/2020 | Surjaatmadja et al. | |
| 2020/0277951 | A1 | 9/2020 | Hunter et al. | |
| 2020/0309113 | A1 | 10/2020 | Hunter et al. | |
| 2021/0140294 | A1 * | 5/2021 | Mollatt | F04B 43/0081 |
| 2021/0148354 | A1 * | 5/2021 | Adams | F04B 45/0533 |
| 2021/0173111 | A1 | 6/2021 | Therrien et al. | |
| 2021/0190065 | A1 | 6/2021 | Ferden et al. | |
| 2021/0246894 | A1 | 8/2021 | Mollatt | |
| 2022/0178368 | A1 | 6/2022 | Montilla Jimenez et al. | |
| 2024/0376809 | A1 | 11/2024 | Hurst et al. | |
| 2024/0376881 | A1 | 11/2024 | Hurst et al. | |
| 2024/0376887 | A1 | 11/2024 | Hurst et al. | |
| 2025/0163784 | A1 | 5/2025 | Clyburn et al. | |

FOREIGN PATENT DOCUMENTS

| | | | | |
|---|---|---|---|---|
| CN | 106761573 | B | 4/2019 | |
| DE | 596227 | C * | 7/1934 | |
| DE | 2253288 | A1 * | 5/1974 | |
| DE | 3706338 | A1 | 9/1988 | |
| EP | 1602830 | A1 | 7/2005 | |
| EP | 2913525 | A1 | 2/2015 | |
| EP | 4286688 | A1 | 12/2021 | |
| FR | 1441747 | A * | 6/1966 | |
| FR | 2367203 | A2 * | 5/1978 | |
| GB | 2185291 | A * | 7/1987 | F04B 43/08 |
| JP | H11159464 | A * | 6/1999 | |
| JP | 2006200464 | A * | 8/2006 | |
| JP | 2006200464 | B2 | 8/2006 | |
| JP | 2007100663 | A * | 4/2007 | |
| KR | 20170016059 | A * | 2/2017 | |
| KR | 1020170016059 | A | 8/2018 | |
| SU | 1359482 | A1 | 12/1987 | |
| WO | 2015078487 | A1 | 6/2015 | |
| WO | 2022099219 | A1 | 5/2022 | |
| WO | 2022164034 | A1 | 8/2022 | |

OTHER PUBLICATIONS

Foreign Communication from Related Application—International Search Report and Written Opinion of the International Searching Authority, International Application No. PCT/US2023/086394, dated Apr. 24, 2024, 11 pages.

Foreign Communication from Related Application—International Search Report and Written Opinion of the International Searching Authority, International Application No. PCT/US2023/086395, dated Apr. 30, 2024, 11 pages.

Foreign Communication from Related Application—International Search Report and Written Opinion of the International Searching Authority, International Application No. PCT/US2023/086389, dated May 1, 2024, 11 pages.

Foreign Communication from Related Application—International Search Report and Written Opinion of the International Searching Authority, International Application No. PCT/US2023/086385, dated May 7, 2024, 11 pages.

Foreign Communication from Related Application—International Search Report and Written Opinion of the International Searching Authority, International Application No. PCT/US2023/086397, dated May 7, 2024, 10 pages.

Filing Receipt, Specification and Drawings for U.S. Appl. No. 18/398,858, filed Dec. 28, 2023, entitled "Bellows Failure Detection for a Pump," 70 pages.

Filing Receipt, Specification and Drawings for U.S. Appl. No. 18/398,885, filed Dec. 28, 2023, entitled "Improved Cooling for Bellows Pump," 80 pages.

Filing Receipt, Specification and Drawings for U.S. Appl. No. 18/398,905, filed Dec. 28, 2023, entitled "Valve Monitoring System for a Bellows Pump," 91 pages.

Filing Receipt, Specification and Drawings for U.S. Appl. No. 18/398,923, filed Dec. 28, 2023, entitled "Active Bellows Pump Valve Management," 81 pages.

Filing Receipt, Specification and Drawings for U.S. Appl. No. 18/399,058, filed Dec. 28, 2023, entitled Protection of Make-Up System for High Pressure Bellows-Stylepump System, 91 pages.

Foreign Communication from Related Application—International Search Report and Written Opinion of the International Searching Authority, International Application No. PCT/US2023/086392, dated Apr. 19.2024, 11 pages.

Filing Receipt, Specification and Drawings for U.S. Appl. No. 18/398,936, filed Dec. 28, 2023, entitled "Systems and Methods Using a Bellows Pump to Perform Operations for a Subterranean Formation," 81 pages.

First Office Action dated Mar. 12, 2025 (8 pages), U.S. Appl. No. 18/398,936, filed Dec. 28, 2023.

(56) References Cited

OTHER PUBLICATIONS

First Office Action dated Jun. 2, 2025 (44 pages), U.S. Appl. No. 18/399,058, filed Dec. 28, 2023.
First Office Action dated Jun. 23, 2025 (47 pages), U.S. Appl. No. 18/399,058, filed Dec. 28, 2023.
First Office Action dated Jul. 2, 2025 (40 pages), U.S. Appl. No. 18/398,905, filed Dec. 28, 2023.
First Office Action dated May 2, 2025 (28 pages), U.S. Appl. No. 18/398,923, filed Dec. 28, 2023.

* cited by examiner

DIRECT CONNECT PISTON-DRIVEN BELLOWS PUMP

CROSS-REFERENCE TO RELATED APPLICATIONS

This application claims priority benefit under 35 U.S.C. 119 (e) of U.S. Provisional Patent Application Ser. No. 63/501,952 (filed May 12, 2023), which is incorporated by reference herein in its entirety.

STATEMENT REGARDING FEDERALLY SPONSORED RESEARCH OR DEVELOPMENT

Not applicable.

FIELD

This disclosure relates generally to the field of pumping, for example pumping of fluids downhole in a well. More particularly, this disclosure relates to systems and methods relating to bellows pumps.

BACKGROUND

To produce hydrocarbons (for example, oil, gas, etc.) from a subterranean formation, wellbores may be drilled that penetrate hydrocarbon-containing portions of the subterranean formation. The portion of the subterranean formation from which hydrocarbons may be produced is commonly referred to as a "production zone." In some instances, a subterranean formation penetrated by the wellbore may have multiple production zones at various locations along the wellbore.

Generally, after a wellbore has been drilled to a desired depth, completion operations are performed. Such completion operations may include inserting a liner or casing into the wellbore and, at times, cementing the casing or liner into place. Once the wellbore is completed as desired (lined, cased, open hole, or any other known completion), treatment, such as a stimulation operation, may be performed to enhance hydrocarbon production into the wellbore. Examples of some common stimulation operations involve hydraulic fracturing, acidizing, fracture acidizing, and hydro-jetting. Stimulation operations are intended to increase the flow of hydrocarbons from the subterranean formation surrounding the wellbore into the wellbore itself so that the hydrocarbons may then be produced up to the wellhead.

One typical formation stimulation process may involve hydraulic fracturing of the formation and placement of a proppant in those fractures. Typically, a treatment/stimulation fluid (which may comprise a clean fluid and a proppant) may be mixed at the surface before being pumped downhole in order to induce fractures or perforations in the formation of interest. The creation of such fractures or perforations will increase the production of hydrocarbons by increasing the flow paths into the wellbore.

Various types of pumps have been used in well operations such as hydraulic fracturing. However, given the difficult conditions and related wear and reliability issues that may arise when pumping treatment fluids for a hydrocarbon well, there is need for improved pumps and related systems and methods.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
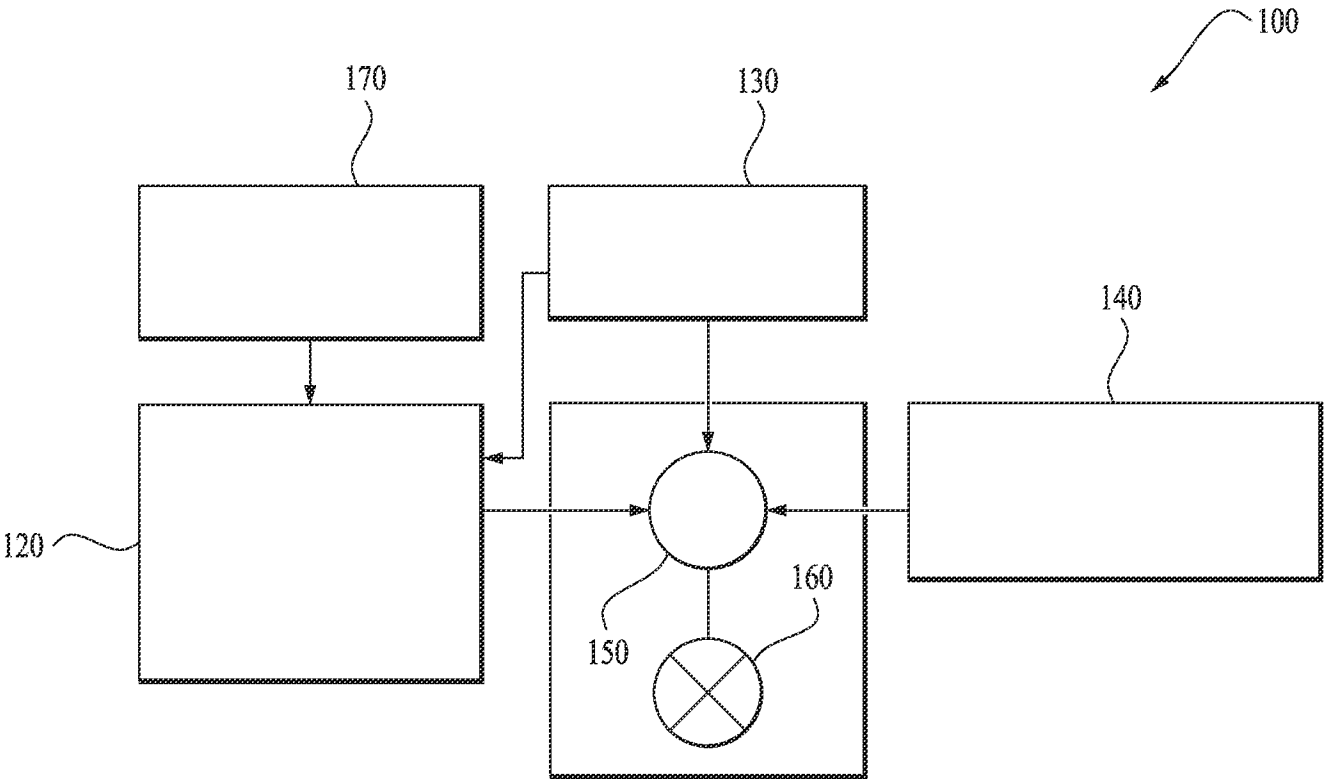
FIG. 1 is a schematic illustration of an exemplary well treatment system, such as an exemplary fracturing system, according to an embodiment of the disclosure.

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

As used herein the terms "uphole", "upwell", "above", "top", and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand. Orientation terms "upstream" and "downstream" are defined relative to the direction of flow of fluid. "Upstream" is directed counter to the direction of flow of fluid, while "downstream" is directed in the direction of flow of fluid, as persons of skill will understand.

Disclosed embodiments illustrate exemplary devices, systems, and methods for using treatment fluids to carry out subterranean treatments in conjunction with a variety of subterranean operations, including but not limited to, hydraulic fracturing operations, fracturing acidizing operations to be followed with proppant hydraulic fracturing operations, stimulation treatments, drilling, cementing, and the like. For example, treatment fluid may be introduced into a wellbore (e.g. which penetrates a subterranean formation) at a pressure sufficient to create or enhance one or more fractures within the subterranean formation (for example, hydraulic fracturing) and/or to create or enhance and treat microfractures within a subterranean formation in fluid communication with a primary fracture in the formation. In one or more embodiments, the systems and methods of the present disclosure may be used to treat pre-existing fractures, or fractures created using a different treatment fluid. In one or more embodiment, a treatment fluid may be introduced at a pressure sufficient to create or enhance one or more fractures within the formation, and/or one or more of the treatment fluids may include a proppant material which subsequently may be introduced into the formation. In embodiments, treatment fluid can be any fluid (and may in some instances include solid particles therein) which can be pumped into a well. In embodiments, treatment fluid may differ from drive fluid used within a pump mechanism.

By way of example, FIG. 1 schematically illustrates an exemplary fracturing system 100. The fracturing system 100 may be implemented using the systems, methods, and techniques described herein. In particular, the disclosed systems, methods, and techniques may directly or indirectly affect one or more components or pieces of equipment associated with the example fracturing system 100, according to one or more embodiments. In embodiments, the fracturing system 100 may comprise one or more of the following: a fracturing fluid producing apparatus 120, a fluid source 130, a solid source 140, an additive source 170, and a pump and blender system 150. All or an applicable combination of these components of the fracturing system 100 may reside at the surface at a well site/fracturing pad where a well 160 can be located.

During a fracturing job, the fracturing fluid producing apparatus 120 may access the fluid source 130 for introducing/controlling flow of a fluid, e.g. a treatment fluid such as fracturing fluid, in the fracturing system 10. While only a single fluid source 130 is shown, the fluid source 130 may include a plurality of separate fluid sources (e.g. storage tanks). In some embodiments, the fracturing fluid producing apparatus 120 may be omitted from the fracturing system 100, with the fracturing fluid instead being sourced directly from the fluid source 130 during a fracturing job rather than through the intermediary fracturing fluid producing apparatus 120.

The fracturing fluid may be an applicable fluid for forming fractures during a fracture stimulation treatment of the well 160. For example, the fracturing fluid may include water, a hydrocarbon fluid, a polymer gel, foam, air, wet gases, and/or other applicable fluids. In various embodiments, the fracturing fluid may include a concentrate to which additional fluid is added prior to use in a fracture stimulation of the well 160. In certain embodiments, the fracturing fluid may include a gel pre-cursor with fluid, e.g. liquid or substantially liquid, from fluid source 130. Accordingly, the gel pre-cursor with fluid may be mixed by the fracturing fluid producing apparatus 120 to produce a hydrated fracturing fluid for forming fractures.

The solid source 140 may include a volume of one or more solids which may be mixed with a fluid, e.g. the fracturing fluid, to form a solid-laden fluid. The solid-laden fluid may be pumped into the well 160 as part of a solid-laden fluid stream that is used to form and stabilize fractures in the well 160 during a fracturing job. The one or more solids within the solid source 140 may include applicable solids that may be added to the fracturing fluid of the fluid source 130. Specifically, the solid source 140 may contain one or more proppants for stabilizing fractures after they are formed during a fracturing job, e.g. after the fracturing fluid flows out of the formed fractures. For example, the solid source 140 may contain sand.

The fracturing system 100 may also include an additive source 170. The additive source 170 may contain/provide one or more applicable additives that may be mixed into fluid, e.g. the fracturing fluid, during a fracturing job. For example, the additive source 170 may include solid-suspension-assistance agents, gelling agents, weighting agents, and/or other optional additives to alter the properties of the fracturing fluid. The additives may be included in the fracturing fluid to reduce pumping friction, to reduce or eliminate the fluid's reaction to the geological formation in which the well is formed, to operate as surfactants, and/or to serve other applicable functions during a fracturing job. As will be discussed in greater detail later, the additives may function to maintain solid particle suspension in a mixture of solid particles and fracturing fluid as the mixture is pumped down the well 160 to one or more perforations.

The pump and blender system 150 functions to pump treatment fluid into the well 160. Specifically, the pump and blender system 150 of FIG. 1 may pump fracture fluid from the fluid source 130, e.g. fracture fluid that is received through the fracturing fluid producing apparatus 120, into the well 160 for forming and potentially stabilizing fractures as part of a fracture job. The pump and blender system 150 may include one or more pumps. Specifically, the pump and blender system 150 may include a plurality of pumps that may operate together, e.g. concurrently, to form fractures in a subterranean formation as part of a fracturing job. The one or more pumps included in the pump and blender system 150 may be any applicable type of fluid pump. For example, the pumps in the pump and blender system 150 may include electric pumps and/or hydrocarbon and hydrocarbon mixture powered pumps, such as diesel-powered pumps, natural gas-powered pumps, and diesel combined with natural gas-powered pumps. In one or more embodiments, one or more of the pumps in the pump and blender system 150 may be a bellows pump.

In some embodiments, the pump and blender system 150 may also function to receive the fracturing fluid and combine it with other components and solids (e.g. with the pump and blender system 150 optionally comprising a blender unit). Specifically, the pump and blender system 150 may combine the fracturing fluid with volumes of solid particles, e.g. proppant, from the solid source 140 and/or additional fluid and solids from the additive source 170. In turn, the pump and blender system 150 may pump the resulting mixture down the well 160 at a sufficient pumping rate to create or enhance one or more fractures in a subterranean zone, for example, to stimulate production of fluids from the zone. While the pump and blender system 150 is described to perform both pumping and mixing of fluids and/or solid particles, in various embodiments, the pump and blender system 150 may function to just pump a fluid stream, e.g. a treatment and/or fracture fluid stream, down the well 160 to create or enhance one or more fractures in a subterranean zone. In some embodiments, a separate pump and/or separate blender may be used (e.g. independently of each other or alone).

In embodiments, one or more elements/components of the system may be monitored (e.g. using one or more sensor). For example, the fracturing fluid producing apparatus 120, fluid source 130, and/or solid source 140 may be equipped with one or more monitoring devices (not shown). The monitoring devices may be used to control the flow of fluids, solids, and/or other compositions to the pumping and blender system 150. Such monitoring devices may effectively allow the pumping and blender system 150 to source from one, some, or all of the different sources at a given time. In turn, the pumping and blender system 150 may provide just fracturing fluid into the well 160 at some times, just solids or solid slurries at other times, and combinations of those components at other times.

Figure 2:
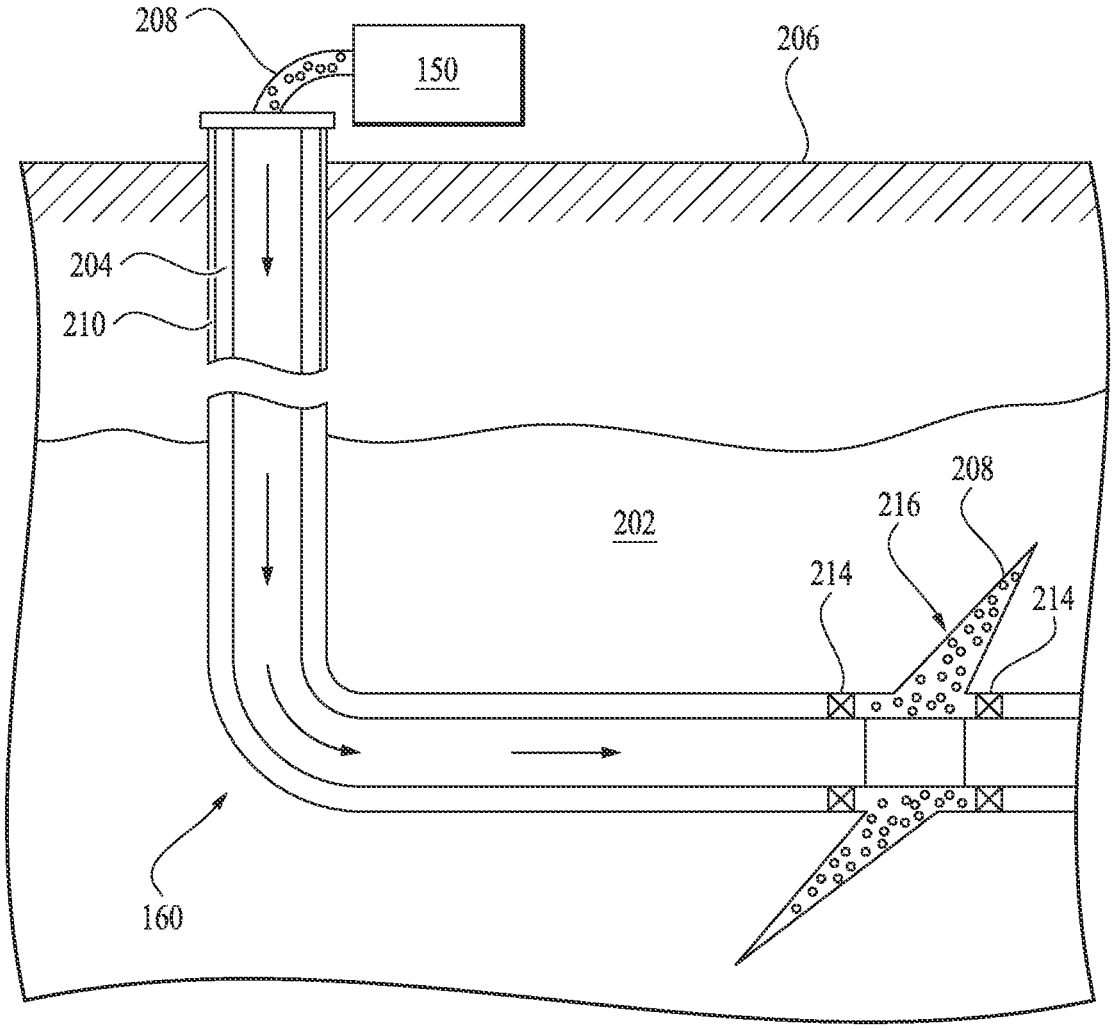
FIG. 2 is a schematic illustration of an exemplary well during a treatment operation, according to an embodiment of the disclosure.

FIG. 2 illustrates an exemplary well 160 during a treatment operation (e.g. a fracturing operation) in a portion of a subterranean formation of interest 202 surrounding a wellbore 204. In embodiments, the downhole operation may be performed using one or an applicable combination of the components in the example system 100 shown in FIG. 1. The wellbore 204 of FIG. 2 extends from a surface 206, and a fracturing fluid 208 is applied to a portion of the subterranean formation 202 (e.g. surrounding the horizontal portion of the wellbore 204). Although shown as vertical deviating to horizontal, the wellbore 204 may include horizontal, vertical, slant, curved, and other types of wellbore geometries and orientations, and the fracturing treatment may be applied to a subterranean zone surrounding any portion of the wellbore 204. The wellbore 204 may include a casing 210 that is cemented or otherwise secured to the wellbore wall. The wellbore 204 may be uncased or otherwise include uncased sections. Perforations may be formed in the casing 210 to allow fracturing fluids and/or other materials to flow into the subterranean formation 202. In the example fracture operation shown in FIG. 2, a perforation is created between points 214 (which may represent one or more packer element in some embodiments) defining an isolated zone.

The pump and blender system 150 (or in some embodiments, just a pump or a separate pump and a separate blender) may be fluidly coupled to the wellbore 204 to pump treatment fluid (e.g. fracturing fluid 208), and potentially other applicable solids and solutions, into the wellbore 204. When the fracturing fluid 208 is introduced into wellbore 204, it may flow through at least a portion of the wellbore 204 to the perforation, for example defined by points 214 in FIG. 2. The fracturing fluid 208 may be pumped at a sufficient pumping rate through at least a portion of the wellbore 204 to create one or more fractures 216 through the perforation and into the subterranean formation 202. Specifically, the fracturing fluid 208 may be pumped at a sufficient pumping rate to create a sufficient hydraulic pressure at the perforation to form the one or more fractures 216. Further, solid particles, e.g. proppant from the solid source 140, may be pumped into the wellbore 204, e.g. within the fracturing fluid 208 towards the perforation. In turn, the solid particles may enter the fractures 216 where they may remain after the fracturing fluid flows out of the wellbore. These solid particles may stabilize or otherwise "prop" the fractures 216, such that fluids may flow freely through the fractures 216.

While only two perforations at opposing sides of the wellbore 204 are shown in FIG. 2, greater than two perforations may be formed in the wellbore 204 as part of a perforation cluster. Fractures may then be formed through the plurality of perforations in the perforation cluster as part of a fracturing stage for the perforation cluster. Specifically, fracturing fluid and solid particles may be pumped into the wellbore 204 and pass through the plurality of perforations during the fracturing stage to form and stabilize the fractures through the plurality of perforations.

The pump and blender system 150 may comprise a pump (e.g. a high-pressure pump), which may be used, either alone or in combination with one or more other pumps, to pressurize a treatment fluid and/or introduce the treatment fluid into wellbore 204 penetrating at least a portion of a subterranean formation to perform a treatment therein. For example, in hydraulic fracturing operations, one or more pumps may be used to pump a treatment fluid (e.g. fracturing fluid 208, which typically may be a slurry mixture of proppant and/or sand mixed with water) into the formation.

In some embodiments, the pump may comprise a bellows pump 300, which may be configured to segregate treatment fluid from drive fluid (sometimes termed power fluid). See for example FIG. 3, which schematically illustrates a bellows pump 300. The bellows pump 300 may comprise a power end 310, a fluid end 320, and an expandable bellows 330. The fluid end 320 may have a chamber 321 within a fluid end housing 323, a suction valve 326 in fluid communication with (e.g. fluidly coupled to) the chamber 321 and a source/reservoir for the treatment fluid 350 (e.g. with the suction valve 326 being configured to allow for insertion of treatment fluid into the chamber 321), and a discharge valve 328 in fluid communication with (e.g. fluidly coupled to) the chamber 321 and the well (e.g. with the discharge valve 328 being configured to allow for insertion of treatment fluid from the chamber 321 into the well or any other place where treatment fluid is intended to be pumped). While the suction valve 326 and discharge valve 328 may be disposed within the housing 323 for the fluid end 320 in some embodiments, in other embodiments, the suction valve 326 and discharge valve 328 may be located within other components (such as piping) that fluidly couples the valves to the elements/components of the pump 300 as described.

In embodiment, the power end 310 may be fluidly connected to (e.g. in fluid communication with) the bellows 330 (e.g. the inner volume of the bellows) and/or configured to reciprocally expand/inflate and contract/deflate the bellows 330 based on movement of drive fluid 311 (sometimes termed power fluid). The bellows 330 may be configured to reciprocally expand and/or retract within the chamber 321 of the fluid end 320 based on movement of the drive fluid 311. In some embodiments, the bellows 330 may be sealingly coupled to an opening in the chamber 321 of the fluid end 320 (e.g. coupled to the wall of the chamber), so that fluid communication between the power end 310 and the bellows 330 causes reciprocal movement of the bellows 330 within the chamber 321. In some embodiments, the power end 310 may be (e.g. sealingly) coupled to the fluid end 320, with no flow of treatment fluid or drive fluid therebetween (e.g. since the bellows 330 separates the fluids).

In embodiments, the bellows 330 may comprise a flexible/expandable bag or body, typically of thin, flexible material, whose inner volume (e.g. the open space therein, which may be configured to hold drive fluid) can be changed (e.g. based on the amount/pressure of fluid therein). The bellows 330 may have an opening allowing fluid communication of drive fluid 311 with the power end 310, but in some embodiments may otherwise have a form configured to retain fluid therein. For example, the bellows 330 may be configured to prevent fluid transfer between its interior and the chamber 321 of the fluid end 320 external to the bellows 330. In some embodiments, the bellows 330 may comprise an elastomeric element and/or material. In some embodiments, the bellows 330 may comprise metal material and/or may include an accordion-like configuration (e.g. having pleats or folds or convolutions). In some embodiments, exemplary metal bellows may be formed of a metal that is sufficiently flexible and/or durable and configured appropriately to effectively withstand repeated back and forth motion due to reciprocal movement without breaking or wearing to failure for a reasonable life of the bellows. For example, the bellows may comprise stainless steel, nickel alloys such as Inconel & Monel, hastealloy, and/or copper alloys. In some embodiments, the bellows 330 may not be configured to withstand significant pressure differentials. In some embodiments, the bellows 330 may be configured to separate (e.g. isolate) drive fluid 311 (e.g. clean fluid) from treatment fluid (e.g. dirty fluid, such as fluid having proppant, abrasives, and/or corrosive materials, such as from treatment fluid source 350).

The bellows 330 may be disposed in and/or configured to expand into the chamber 321 of the fluid end 320, and may be configured to serve as a separating barrier that divides the chamber 321 into a first volume 373 within the bellows 330 and a second volume 375 outside of the bellows 330. The first volume 373 (e.g. inner volume of the bellows 330) may be in fluid communication with the power end 310, and may in some embodiments contain drive fluid. The second volume 375 of the chamber 321 is in fluid communication with the suction valve 326 and discharge valve 328, and is configured for treatment fluid to flow therethrough. The bellows 330 may serve as a fluid separating barrier between the drive fluid 311 in the first volume 373 and the treatment fluid in the second volume 375. The bellows 330 may be configured to flex (e.g. expand and/or contract) to balance pressure between the first volume 373 and second volume 375 during operation of the pump 300. In some embodiments, the bellows 330 may be configured to flex axially. The power end 310 of pump 300 may be sealingly connected to the fluid end 320, to prevent entry of treatment fluid from the fluid end 320 into the power end 310.

The chamber 321 may be downstream of the fluid treatment source 350 and upstream of the well 160. Typically, the suction valve 326 can be a one-way check valve configured to allow treatment fluid from the treatment fluid source 350 to enter the chamber 321 (e.g. during a suction stroke of the pump 300), and the discharge valve 328 can be a one-way check valve configured to allow treatment fluid to exit the chamber 321 towards the well (e.g. during a power/discharge stroke of the pump 300). The reciprocating expansion and retraction of the bellows 330 in the chamber 321 (e.g. with the bellows 330 expanding/inflating for the discharge stroke and contracting/deflating for the suction stroke) can be configured to work in conjunction with the suction valve 326 and discharge valve 328 to allow the fluid end 320 to pump treatment fluid into the well 160. For example, during a discharge stroke, as drive fluid 311 enters the first volume 373 (e.g. the inner volume of the bellows 330), the bellows 330 inflates and treatment fluid is expelled from the second volume 375 of the chamber 321 through the discharge valve 328. Once the discharge stroke is complete, a suction stroke can begin. During the suction stroke, drive fluid 311 inside the first volume 373 exits the bellows 330, the bellows 330 deflates, and treatment fluid can be drawn through the suction valve 326 into the second volume 375 of the chamber 321. Once the bellows 330 is compressed to its minimum desired/permitted length, another discharge stroke can begin.

The bellows 330 may be configured to separate treatment fluid, which the pump 300 may be pumping into the well 160, from drive fluid 311 used for pump operations. By way of example, the drive fluid 311 may be chosen from a desirable group of liquids, which may include hydraulic fluid such as water or hydraulic oil. In some embodiments, the drive fluid 311 may also serve as a lubricant for the pump 300, for example forming a barrier against wear due to friction. In the case of a fracturing operation or a fracturing pump, the treatment fluid may be a fracturing fluid that may comprise a base fluid (e.g., water, oils, organic liquids, etc.) as well as any other suitable components or additives useful for the fracturing treatment. For example, the fracturing fluid may be a slurry containing sand or synthetic proppants and/or a variety of chemical additives such as gelling agents, acids, friction reducers, and solvents.

In various embodiments, any mechanism for causing reciprocal movement of the bellows 330 (e.g. by movement of the drive fluid 311) can provide the pumping action for the pump 300. In some embodiments, the power end 310 may further comprise a piston or plunger 410 configured to reciprocally move drive fluid 311 (e.g. in and out of the bellows 330). See for example FIG. 4, which schematically illustrates an embodiment of the bellows pump 300 having a piston/plunger 410. Reciprocal movement (e.g. axial translation) of the piston/plunger 410 within a bore 420 of the power end housing 413 may cause the reciprocal movement (e.g. expanding and contracting) of the bellows 330 (e.g. within the chamber 321 of the fluid end 320), for example with the piston/plunger 410 displacing fluid (e.g. hydraulic drive fluid 311) which is located in the bore 420 between the driven end of the piston/plunger 410 (e.g. the end in proximity to the bellows 330) and the bellows 330. Since the bore 420 is fluidly coupled to (e.g. in fluid communication with) the bellows 330, the piston/plunger 410 reciprocally displacing drive fluid 311 can induce reciprocal movement (e.g. expansion and contraction) of the bellows 330. As used herein, reference to "piston" shall include both conventional piston and plunger elements for convenience of reference.

Figure 4:
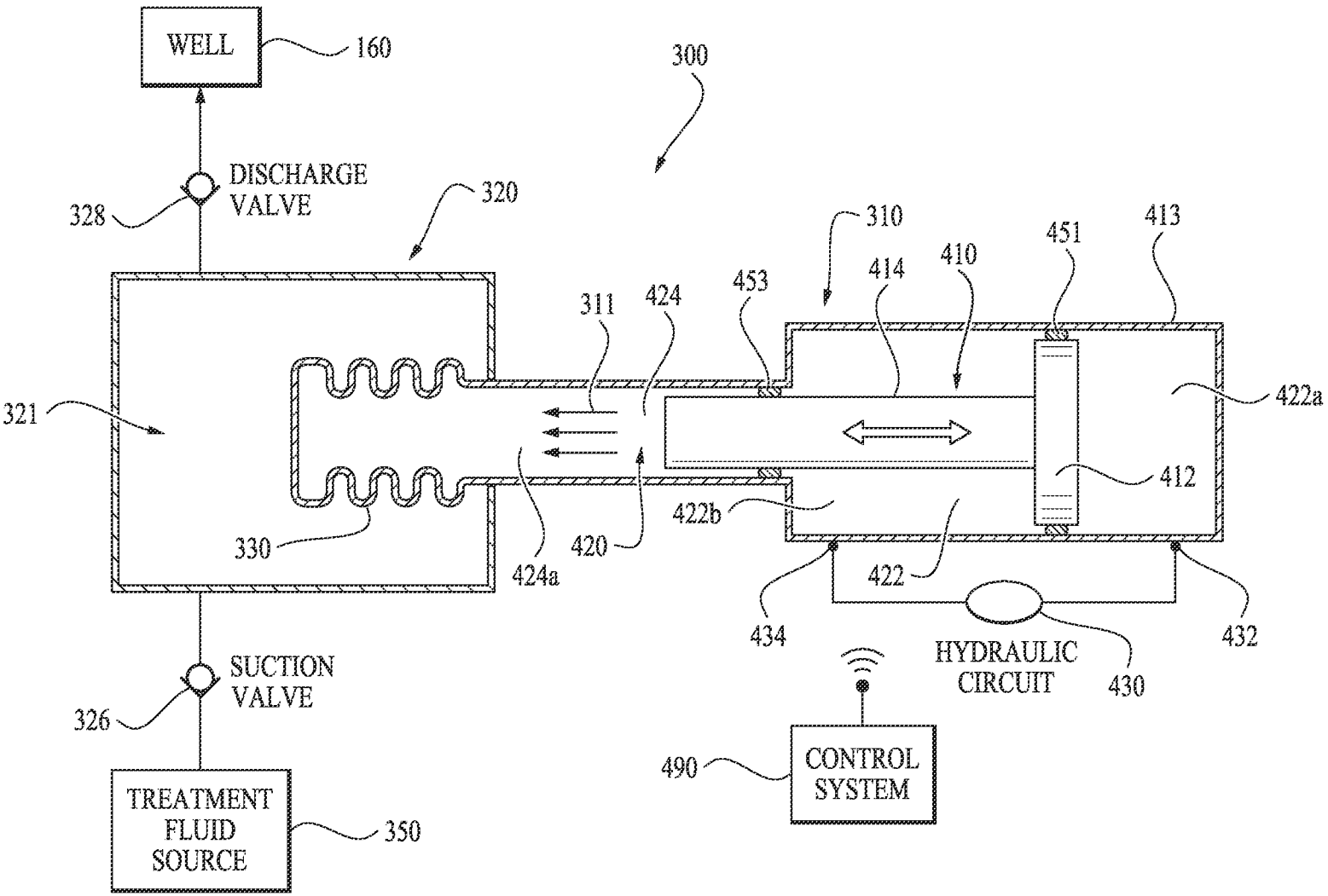
FIG. 4 is a schematic illustration of an exemplary bellows pump with piston/plunger, according to an embodiment of the disclosure.

In embodiments, the piston 410 may be configured to sealingly move within the bore 420, for example having one or more seal (configured to engage between the piston 410 and the bore 420) disposed on the piston 410 and/or on the inner wall of the bore 420. In some embodiments, one or more seal may comprise pump packing. In some embodiments, the bellows 330 may be configured to protect the piston 410 from wear, for example by separating the piston 410 from the treatment fluid in the fluid end 320. In some embodiments, the piston 410 may be configured so that, during its reciprocal movement in the bore 420, the piston 410 does not extend into the inner volume of the bellows 330; while in other embodiments, the piston 410 may be configured to extend partially into the bellows during a discharge stroke. Regardless, the piston 410 may be configured to not contact the bellows 330 (e.g. the end of the bellows) during its reciprocal movement. The piston 410 can be driven/powered by any suitable means, including various types of driver elements configured to induce reciprocal movement of the piston 410, such as a hydraulic circuit, a combustion engine, an electric motor, a linear actuator, rack and pinion, etc. In the example of FIG. 4, the piston 410 may be driven by a hydraulic circuit 430. In other exemplary embodiments, the pump 300 may be powered by natural gas (e.g. via a natural gas-fired engine or natural gas-fired electric generator) produced from the same area in which well treatment (e.g. fracturing) operations are being performed. In some embodiments, a control system 490 may control one or more aspect of the driver (e.g. to control the reciprocation of the piston 410 and thereby the bellows 330) and/or the valves (e.g. 326, 328).

In some embodiments, the piston 410 can comprise a head 412 and a rod 414 (e.g. with the rod 414 disposed between the head 412 and the bellows 330, and extending from the head 412 towards the fluid end 320). In some embodiments, the piston 410 can be driven by a hydraulic circuit 430. For example, the hydraulic circuit 430 of the power end 310 can include a first port 432, located such that the head 412 is disposed between the first port 432 and the rod 414, and a second port 434 located between the head 412 and the bellows 330 (e.g. more proximate the bellows 330 than the first port 432). In some embodiments, the hydraulic circuit 430 may include one or more source of drive fluid and/or one or more pump. For example, the first port 432 may be in fluid communication with a source of drive fluid and/or a pumping mechanism. In some embodiments, the second port 434 may be in fluid communication with a source of drive fluid and/or a pumping mechanism. In some embodiments, the source of drive fluid may be the same for the first port 432 and the second port 434. In some embodiments, the pumping mechanism may be the same for the first port 432 and the second port 434. In some embodiments, the hydraulic circuit 430 may include one or more valve. The hydraulic circuit 430 may be configured to produce pressure differential on either side of the piston 410 (e.g. the head 412), for example by introducing drive fluid (such as hydraulic oil) via the ports (432, 434), which may induce movement/displacement of the piston 410. For example, introducing drive fluid via the first port 432 and/or removing drive fluid via the second port 434 may urge extension of the piston 410 towards the fluid end 320, while introducing drive fluid via the second port 434 and/or removing drive fluid via the first port 432 may retract the piston 410, urging the piston 410 away from the fluid end 320.

While the rod 414 and head 412 may have a similar diameter in some embodiments, in some embodiments the rod 414 may have a smaller diameter than the head 412. The ratio of size differential between the rod 414 and the head 412 can provide an intensifying effect, in which pressure applied to the head 412 is multiplied/increased as applied to the bellows 330 (via the rod 414). For example, the piston 410 may be part of an intensifier configured to intensify applied pressure (e.g. from the driver) to the bellows 330 (e.g. with the rod 414 having a smaller diameter than the head 412). For example, the size difference/ratio between the diameter of the rod 414 and the head 412 may range from approximately 1:1.1 to 1:10 (e.g. from 1:1.5 to 1:10, from 1:2 to 1:10, from 1:3 to 1:10, from 1:5 to 1:10, from 1:7 to 1:10, from 1:1.5 to 1:8, from 1:1.5 to 1:5, from 1:1.5 to 1:3, from 1:2 to 1:8, from 1:2 to 1:5, from 1:2 to 1:3, from 1:3 to 1:10, from 1:3 to 1:8, or from 1:3 to 1:5).

As described above, the power end 310 may include a bore 420 (e.g. in a power end housing 413) in fluid communication with (e.g. fluidly coupled to) the bellows 330 (e.g. an internal volume of the bellows), and the piston 410 can be disposed within the bore 420. In embodiments (e.g. in which the piston 410 is not uniform in diameter along its length), the bore 420 may have a first portion 422 with an inner diameter configured for movement of the head 412 (axially) therethrough and a second portion 424 with an inner diameter configured for movement of the rod 414 (axially) therethrough. For example, the first portion 422 of the bore may have a diameter approximately equal to that of the head 412, while the second portion 424 of the bore may have a diameter approximately equal to that of the rod 414 (e.g. the first portion 422 of the bore may have a larger diameter than the second portion 424 of the bore). In embodiments, the head 412 may separate the first portion 422 of the bore 420 into two cavities (whose volumes may change based on the position of the head 412 within the bore 420), for example with a first cavity 422*a* distally away from the fluid end 320 and/or bellows 330 (e.g. with the head 412 disposed between the first cavity 422*a* and the bellows 330) and a second cavity 422*b* more proximal to the bellows 330 and/or fluid end 320 (e.g. with the second cavity 422*b* disposed between the head 412 and the bellows 330). Interaction of the rod 414 within the second portion 424 of the bore 420 may form a third cavity 424*a* in fluid communication with the bellows 330. In embodiments having a hydraulic circuit as the driver (e.g. as shown in FIG. 4), the first port 432 may be in fluid communication with the first cavity 422*a*, and the second port 434 may be in fluid communication with the second cavity 422*b*. The third cavity 424*a* may be in fluid communication with the bellows 330. Typically, the bore 420 may extend along the longitudinal axis of the power end 310 and/or parallel to the longitudinal axis (e.g. the axis of extension) of the bellows 330.

In operation, the head 412 of the piston 410 may be configured to sealingly move within the first portion 422 of the bore 410 (e.g. during pump strokes), and the rod 414 may be configured to sealingly move within the second portion 424 of the bore 420 (e.g. during pump strokes). In embodiments, the power end 310 may further comprise a first seal 451 configured to seal the head 412 with respect to the first portion 422 of the bore 420 (e.g. such that the head 412 and first seal 451 isolate the first cavity 422*a* from the second cavity 422*b*) and a second seal 453 configured to seal the rod 414 with respect to the second portion 424 of the bore 420 (e.g. such that the rod 414 and second seal 453 isolate the third cavity 424*a* from the second cavity 422*b*). For example, the first seal 451 may be disposed on the head 412 (e.g. a moving seal), such as within one or more groove configured to hold a gasket, or on the bore first portion 422 inner surface (e.g. a stationary seal) and/or the second seal 453 may be disposed on the rod 414 (e.g. a moving seal) or on the bore second portion 424 inner surface (a stationary seal). In some embodiments, the first seal 451 may be a moving seal (e.g. disposed on the head 412) and the second seal 453 may be a stationary seal (e.g. disposed on the inner surface/wall of the bore 420—e.g. within the bore second portion 424—which may in some embodiments comprises pump packing). In some embodiments, one or more stationary seal may be configured to prevent fluid flow between the second portion 424 of the bore and the first portion 422 of the bore and/or to provide a controlled volume of fluid for interaction with the inner volume of the bellows 330. While the discussion has been set forth with regard to a pump 300 having a single bellows 330, similar concepts apply for dual (e.g. double-acting) bellows pumps (e.g. in which a single piston interacts with two bellows, for example such that the discharge stroke for one bellows is the suction stroke for the other).

It can be important for the health of the bellows pump 300 (e.g. to protect the bellows 330 from excessive pressure differentials which could damage the bellows 330) to ensure that the bellows 330 and the piston 410 remain in sync (e.g. with the bellows 330 not exceeding its full permissible extension position when the piston 410 is at its maximum extension at the end of the discharge stroke, and the bellows 330 not exceeding its permissible contraction position when the piston 410 is at its most retracted position at the end of its suction stroke). To aid in maintaining such synchronization between the bellows 330 and the piston 410, the volume of fluid between the rod 414 and the bellows 330 may be maintained at approximately a constant volume. Leaks in the bellows 330 can prove problematic, affecting the amount of sync and potentially damaging the bellows 330. For example, a bellows 330 leak can cause a pressure imbalance between the drive fluid in the bellows 330 and the treatment fluid in the chamber 321, which may damage (e.g. crush) the bellows 330.

Figure 5:
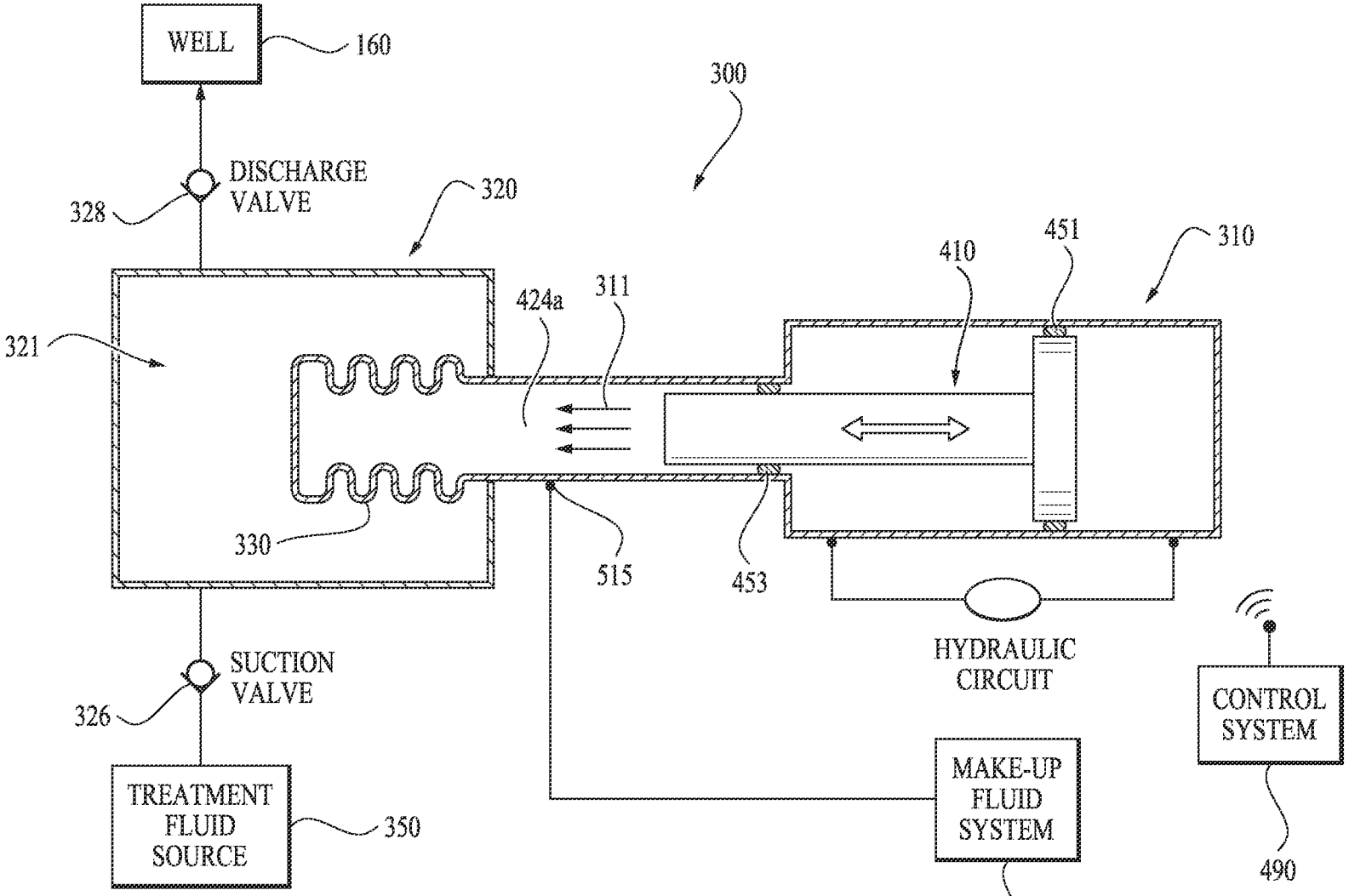
FIG. 5 is a schematic illustration of an exemplary system for providing make-up fluid to an exemplary bellows pump, according to an embodiment of the disclosure.

In order to address any such leak, a make-up system 510 (e.g. as shown schematically with an embodiment of pump 300 in FIG. 5) can be configured to correct/maintain a controlled volume of fluid in the space between the rod 414 and the bellows 330 (for example by injecting make-up fluid, which typically is drive fluid, into the space between the rod 414 and the bellows 330—e.g. into the sealed space formed by the rod seal 453, such as the third cavity 424*a*), in order to maintain synchronization between the bellows 330 and the piston 410. For example, the power end 310 may include a make-up port 515 (e.g. a third port), which may be in fluid communication with the second portion 424 of the bore 420 (e.g. the third cavity 424*a* between the rod 414 and/or rod seal 453 and the bellows 330). While the make-up port 515 is shown with respect to the power end 310 in FIG. 5, in other embodiments, the make-up port 515 may be disposed in the fluid end 320.

A source of make-up fluid may be in fluid communication with the make-up port 515, and the make-up system 510 may further comprise one or more make-up valve configured to open (to provide fluid communication therethrough) and close (to prevent fluid communication therethrough and/or isolate the make-up system 510 from the bellows 330). In some embodiments the make-up system 510 may include a make-up pump, which may be configured to pump make-up fluid from the make-up fluid source into the second portion 424 of the bore 420 through the make-up port 515. The control system 490 in some embodiments may be used to operate the make-up system 510, for example opening and closing the make-up valve and/or operating the make-up pump. In some embodiments, the control system 490 may comprise and/or communicate with one or more sensors, whose data the control system 490 can use to determine if the bellows 330 and piston 410 are out of sync and to operate the make-up system 510 to bring the bellows 330 and piston 410 back into sync. For example, the control system 490 may open the make-up valve and activate the make-up pump to inject make-up fluid into cavity 424*a* and/or to draw make-up fluid out of cavity 424*a* via make-up port 515, in order to bring the bellows 330 and the piston 410 back into sync.

In some embodiments, the pump 300 may be one of a plurality of similar pumps which may be configured to operate together/concurrently (e.g. configured to jointly pump fluid in the well 160 and/or which are jointly driven and/or which share a common drive fluid source and/or make-up fluid source and/or which are jointly controlled). For example, the plurality of pumps 330 may share a common source for treatment fluid, drive fluid, and/or make-up fluid. In some embodiments, the drive fluid and the make-up fluid may be drawn from a common fluid source (e.g. drive fluid and make-up fluid may be substantially the same). In some embodiments, the plurality of pumps 330 can share a common driver. In some embodiments, the plurality of pumps 330 may share a common control system 490. In some embodiments, one or more of the plurality of pumps 330 may be configured to be out-of-sync with one or more other of the plurality of pumps 330 (for example with a first pump undergoing a discharge stroke while a second pump undergoes a suction stroke). In some embodiments, having pumps of the plurality of pumps 330 out-of-sync with each other may allow for continuous pumping of treatment fluid (e.g. under approximately constant pressure). In some embodiments, a first half of the plurality of pumps may be in sync with each other, while a second half of the plurality of pumps may be in sync with each other but out of sync with the first half. In some embodiments, the plurality of pumps may comprise at least two dissimilar pumps.

Some embodiments may include a control system 490, which may be configured to monitor and/or control one or more aspects of the bellows pump 300 and/or related treatment system 100 (e.g. a system including at least one bellows pump 300). The control system 490 may include an information handling system (e.g. comprising one or more processor) and/or may be configured to receive data from one or more sensor configured to monitor/detect one or more parameters of the system. In some embodiments, the parameters monitored may include pressure, temperature, flow rate, viscosity, contamination/particle count, strain, valve position, piston position, and/or bellows position. Data from the sensor(s) may be transmitted to and/or received by the information handling system, for example with the control system 490 using the data to monitor and/or control one or more aspect of the bellows pump 300 and/or system 100. In embodiments, the control system 490 may be configured to communicate with sensors and/or other components of the pump or system wirelessly and/or via wired connection.

Figure 6:
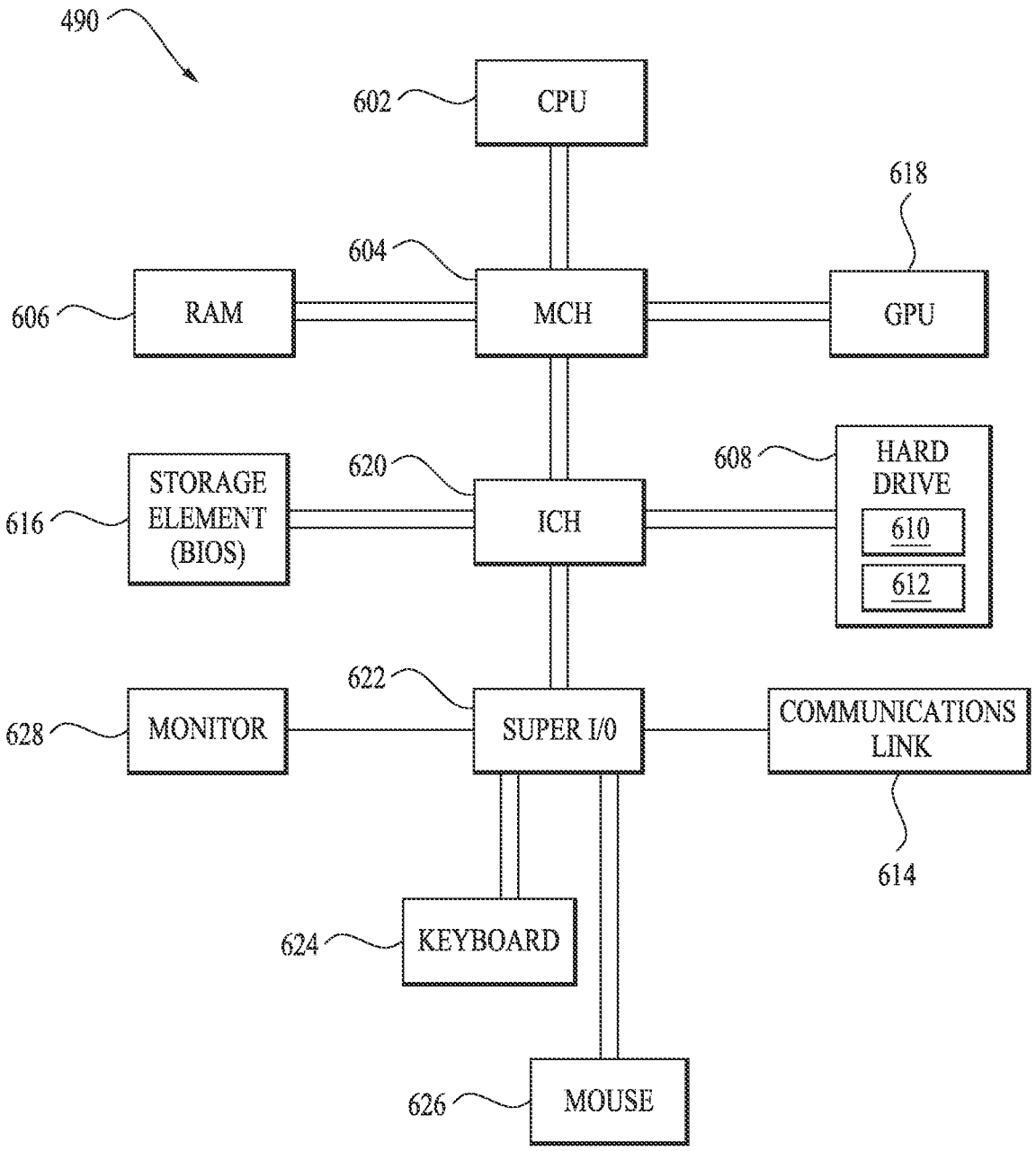
FIG. 6 is a schematic illustration of an exemplary control system, which may be used in conjunction with a bellows pump system, according to an embodiment of the disclosure.

FIG. 6 is a schematic diagram illustrating an exemplary information handling system/control system 490, for example for use with or by an associated treatment system 100 of FIG. 1, according to one or more aspects of the present disclosure. A processor or central processing unit (CPU) 602 of the control system 490 is communicatively coupled to a memory controller hub (MCH) or north bridge 604. The processor 602 may include, for example a microprocessor, microcontroller, digital signal processor (DSP), application specific integrated circuit (ASIC), or any other digital or analog circuitry configured to interpret and/or execute program instructions and/or process data. Processor 602 may be configured to interpret and/or execute program instructions or other data retrieved and stored in any memory (which may for example be a non-transitory computer-readable medium, configured to have program instructions stored therein, or any other programmable storage device configured to have program instructions stored therein) such as memory 606 or hard drive 608. Program instructions or other data may constitute portions of a software or application, for example application 610 or data 612, for carrying out one or more methods described herein.

Memory 606 may include read-only memory (ROM), random access memory (RAM), solid state memory, or disk-based memory. Each memory module may include any system, device or apparatus configured to retain program instructions and/or data for a period of time (for example, non-transitory computer-readable media). For example, instructions from a software or application 610 or data 612 may be retrieved and stored in memory 606 for execution or use by processor 602. In one or more embodiments, the memory 606 or the hard drive 608 may include or comprise one or more non-transitory executable instructions that, when executed by the processor 602, cause the processor 602 to perform or initiate one or more operations or steps. The information handling system 600 may be preprogrammed or it may be programmed (and reprogrammed) by loading a program from another source (for example, from a CD-ROM, from another computer device through a data network, or in another manner).

The data 612 may include treatment data, geological data, fracture data, microseismic data, sensor data, or any other appropriate data. In one or more embodiments, the data 612 may include treatment data relating to fracture treatment plans. For example, the treatment data may indicate a pumping schedule, parameters of a previous injection treatment, parameters of a future injection treatment, or one or more parameters of a proposed injection treatment. Such one or more treatment parameters may include information on flow rates, flow volumes, slurry concentrations, fluid compositions, injection locations, injection times, or other parameters. The treatment data may include one or more treatment parameters that have been optimized or selected based on numerical simulations of complex fracture propagation. In one or more embodiments, the data 612 may include geological data relating to one or more geological properties of the subterranean formation 202 (referring to FIG. 2). For example, the geological data may include information on the wellbore 204 (referring to FIG. 2), completions, or information on other attributes of the subterranean formation 202. In one or more embodiments, the geological data may include information on the lithology, fluid content, stress profile (e.g., stress anisotropy, maximum and minimum horizontal stresses), pressure profile, spatial extent, or other attributes of one or more rock formations in the subterranean zone. The geological data may include information collected from well logs, rock samples, outcroppings, microseismic imaging, or other data sources. In one or more embodiments, the data 612 may include fracture data relating to fractures in the subterranean formation 202. The fracture data may identify the locations, sizes, shapes, and other properties of fractures in a model of a subterranean zone. The fracture data may include information on natural fractures, hydraulically-induced fractures, or any other type of discontinuity in the subterranean formation 202. The fracture data may include fracture planes calculated from microseismic data or other information. For each fracture plan, the fracture data may include information (for example, strike angle, dip angle, etc.) identifying an orientation of the fracture, information identifying a shape (for example, curvature, aperture, etc.) of the fracture, information identifying boundaries of the fracture, or any other suitable information.

In embodiments, the sensor data may include data measured/detected by one or more sensors, for example with relation to one or more aspect of the pump 300 and/or the system 100. For example, the sensor data may include pressure (e.g. at the fluid end 320 and/or the power end 310), temperature (e.g. at the fluid end 320 and/or power end 310 and/or make-up system 510), flow rate (e.g. within the fluid end 310 and/or hydraulic circuit 430 and/or the make-up system 510), viscosity (e.g. of treatment fluid in the fluid end 320 and/or drive fluid in the power end 310), contamination/particle count (e.g. at the fluid end 320 and/or power end 310 and/or in the make-up system 510), strain (e.g. at the fluid end 320 and/or power end 310), suction valve 326 and/or discharge valve 328 position, piston position, and/or bellows position. Data received by the control system 490 (e.g. from one or more sensors) may be used to carry out operations with respect to the pump 300 and/or system 100. For example, the control system 490 may evaluate the data and determine one or more action based on the evaluation. In some embodiments, the control system 490 may automatically take action based on the evaluation.

The one or more applications 610 may comprise one or more software applications, one or more scripts, one or more programs, one or more functions, one or more executables, or one or more other modules that are interpreted or executed by the processor 602. For example, the one or more applications 610 may include a fracture design module, a reservoir simulation tool, a hydraulic fracture simulation model, or any other appropriate function block. The one or more applications 610 may include machine-readable instructions for performing one or more of the operations related to any one or more embodiments of the present disclosure. The one or more applications 610 may include machine-readable instructions for generating a user interface or a plot, for example, illustrating fracture geometry (for example, length, width, spacing, orientation, etc.), pressure plot, hydrocarbon production performance, pump performance. The one or more applications 610 may obtain input data, such as treatment data, geological data, fracture data, or other types of input data, from the memory 606, from another local source, or from one or more remote sources (for example, via the one or more communication links 614). The one or more applications 610 may generate output data and store the output data in the memory 606, hard drive 608, in another local medium, or in one or more remote devices (for example, by sending the output data via the communication link 614).

Memory controller hub 604 may include a memory controller for directing information to or from various system memory components within the information handling system 600, such as memory 606, storage element 616, and hard drive 608. The memory controller hub 604 may be coupled to memory 606 and a graphics processing unit (GPU) 618. Memory controller hub 604 may also be coupled to an I/O controller hub (ICH) or south bridge 620. I/O controller hub 620 is coupled to storage elements of the information handling system 600, including a storage element 616, which may comprise a flash ROM that includes a basic input/output system (BIOS) of the computer system. I/O controller hub 620 is also coupled to the hard drive 608 of the information handling system 600. I/O controller hub 320 may also be coupled to an I/O chip or interface, for example, a Super I/O chip 622, which is itself coupled to several of the I/O ports of the computer system, including a keyboard 624, a mouse 626, a monitor (or other display) 628 and one or more communications link 614. Any one or more input/output devices receive and transmit data in analog or digital form over one or more communication links 614 such as a serial link, a wireless link (for example, infrared, radio frequency, or others), a parallel link, or another type of link. The one or more communication links 614 may comprise any type of communication channel, connector, data communication network, or other link. For example, the one or more communication links 614 may comprise a wireless or a wired network, a Local Area Network (LAN), a Wide Area Network (WAN), a private network, a public network (such as the Internet), a WiFi network, a network that includes a satellite link, or another type of data communication network.

Modifications, additions, or omissions may be made to FIG. 6 without departing from the scope of the present disclosure. For example, FIG. 6 shows a particular configuration of components of control system 490. However, any suitable configurations of components may be used. For example, components of control system 490 may be implemented either as physical or logical components. Furthermore, in some embodiments, functionality associated with components of control system 490 may be implemented in special purpose circuits or components. In other embodiments, functionality associated with components of control system 490 may be implemented in configurable general-purpose circuit or components. For example, components of control system 490 may be implemented by configured computer program instructions.

Certain piston-driven bellows-style pumps may have one or more issues and/or limitations. Conventionally, separate intensifiers, pump fluid ends (with bellows), and suction/discharge valving have been interconnected using piping, for example with hookup occurring at the well site. The use of such interconnecting piping within the pump system can introduce one or more undesirable effects, however. For example, such piping may be subjected to significant cyclical pressure-induced fatigue. Such piping may also be subject to stress during transportation. These sorts of stresses can lead to reduced lifespan, increased failure rates (which may be a safety and/or environmental concern), and/or increased maintenance (which may lead to more unproductive downtime, thereby affecting overall productivity of a well). Further, since the piping (and particularly the piping connection) is often a weak point in the system, and since making and breaking such piping connections may cause still further leaks, a number of leak points may exist in such a system, which can be an environmental and/or safety concern. Interconnecting piping may also lead to the system having a larger footprint at the well site, which can be a concern due to space limitations.

Additionally or alternatively, the interconnecting piping may cause significant unswept volume between the intensifier and the fluid end. This unswept volume of fluid between the intensifier and the fluid end must be compressed before the fluid end can begin working (e.g. to pump treatment fluid into the well), which may reduce system efficiency and/or performance. Due to these and other issues relating to existing pumping systems, improvements to the pump structure, configuration, and approach may be useful, for example addressing one or more of these issues. Disclosed embodiments relate to improved piston-driven bellows pump embodiments, for example which may be redesigned and reconfigured for direct connection of the power end (e.g. intensifier) to the fluid end and/or for optimization of pump performance and/or efficiency.

Figure 7:
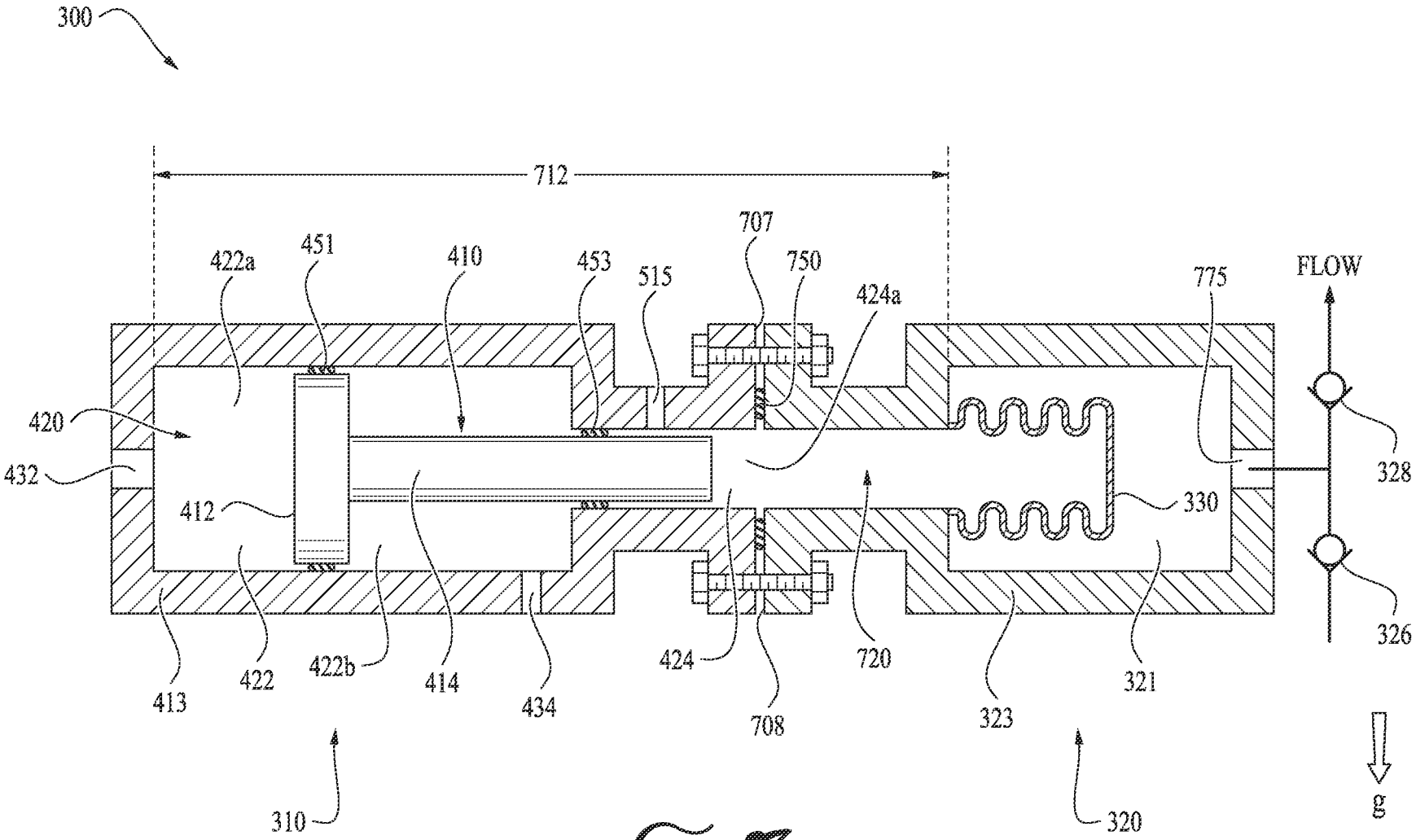
FIG. 7 is a cross-sectional view of an exemplary piston-driven bellows pump, according to an embodiment of the disclosure.

FIG. 7 illustrates a cross-sectional view of an exemplary pump 300 according to an embodiment of this disclosure. In one or more aspect, the pump 300 of FIG. 7 may be similar to the embodiments discussed with respect to FIGS. 3-5. Specifically, the pump 300 of FIG. 7 may comprise: a power end 310, having a piston 410 disposed (at least partially) in a power end bore 420; a fluid end 320, typically having a fluid end bore 720 and a chamber 321 which is configured to be in fluid communication with a suction valve 326 and a discharge valve 328; and an expandable bellows 330 disposed in the chamber 321 and in fluid communication with the fluid end bore 720 and/or the power end bore 420. For example, in embodiments (such as shown in FIG. 7) having a fluid end bore 720, the bellows 330 can be in fluid communication with the power end bore 420 through the fluid end bore 720, while in any similar embodiments without a fluid end bore 720 (e.g. in which the bellows is directly coupled to the power end bore 420), the bellows 330 may be in direct fluid communication with the power end bore 420. In embodiments, the power end 310 can be configured to reciprocally expand and contract the bellows 330 within the chamber 321 based on movement of fluid by the piston 410.

In some embodiments, the power end bore 420 and the fluid end bore 720 can be fluidly coupled (e.g. in fluid communication) to form a unitary, continuous, and/or unbroken pump bore 712 without external piping therebetween. In some embodiments, the power end bore 420 and the fluid end bore 720 may be fluidly coupled without unswept volume therebetween, thereby minimizing any unswept volume between the piston 410 and the bellows 330. As shown in FIG. 7, the power end 310 can further comprise a power end housing 413 (e.g. with the power end bore 420 disposed therein), and the fluid end 320 can further comprise a fluid end housing 323 (e.g. with the chamber 321 and fluid end bore 720 disposed therein). In embodiments, the power end housing 413 and the fluid end housing 323 can be configured to be directly coupled together (e.g. with no piping and/or unswept volume therebetween), and the unitary, continuous, and/or unbroken pump bore 712 (e.g. the bore for the pump 300 as a whole) which is formed by the coupling may be entirely disposed within the power end housing 413 and the fluid end housing 323 (e.g. due to direct contact and coupling of the power end housing 413 to the fluid end housing 323, which may jointly form an overall pump housing, having the single, continuous pump bore 712 extending therethrough). In embodiments, the pump bore 712 may consist essentially of the power end bore 420 and the fluid end bore 720, for example contacting with open ends aligning to form a continuous channel/bore in fluid communication with the bellows 330. In embodiments, all fluid communication between the piston 410 and the bellows 330 may occur via the pump bore 712, which may be entirely disposed within the overall pump housing.

As persons of skill will appreciate, unswept volume can be thought of as the volume of drive fluid in the pump 300 which is not moved/swept by the piston 410. For example, unswept volume in a bellows pump 300 may be the volume between the distal end of the piston 410 at the end of its discharge stroke and the bellows 330 (e.g. the distal end of the bellows). This is as opposed to swept volume, which is the volume of drive fluid swept by the piston 410 as it moves between suction and discharge strokes. For a pump embodiment having external piping between the power end and the distal end (e.g. fluidly coupling the power end bore to the fluid end bore), such piping would represent upswept volume therebetween. By direct coupling of the power end t310 *o* the fluid end 320, the embodiment of FIG. 7 may eliminate or minimize unswept volume.

Typically, the pump housing may comprise a strong, fairly rigid, solid material and be configured to be capable of withstanding pump pressures and stresses. For example, the pump housing (e.g. the power end housing 413 and/or the fluid end housing 323) may comprise steel, cast iron, bronze alloys, nickel alloys, or composites and/or may have walls which are approximately 0.5" to 3" thick, for example depending on pressures within the relevant housing and strength of chosen material for the relevant housing. In embodiments, the walls of the pump housing (e.g. the power end housing 413 and the fluid end housing 323) may be approximately uniformly thick, although in some embodiments, the power end housing 413 may have walls that are thinner than the fluid end housing 323 walls, for example with each of the power end housing 413 and the fluid end housing 323 having uniformly thick walls. In embodiments, the contacting open ends of the power end bore 420 and the fluid end bore 720 may have approximately the same diameter/cross-section. For example, the narrower second portion 424 of the bore 420 in the power end 310 may have approximately the same diameter/cross-section as the fluid end bore 720 (or at least the portion of the fluid end bore 720 proximate to the power end bore 420 upon coupling of the power end housing 413 to the fluid end housing 323).

As shown in FIG. 7, the power end housing 413 and the fluid end housing 323 each may have corresponding faces 707, 708 (e.g. flanges) configured for physical coupling of the power end housing 413 directly to the fluid end housing 323. For example, the corresponding faces 707, 708 can be configured for mechanical coupling (e.g. configured to be bolted together). In embodiments, the mechanical coupling may be a removable/releasable coupling, which may allow for the power end housing 413 and the fluid end housing 323 to be coupled for joint operation (e.g. pumping of treatment fluid), but also to be uncoupled, for example for maintenance. The physical coupling may be sufficiently strong to withstand pumping pressures and/or stresses, for example so that when coupled the power end housing 413 and the fluid end housing 323 act in the same manner as a single, unitary housing (e.g. formed without any joint). In embodiments, the corresponding faces 707, 708 can be configured for parallel mating contact. For example, each face 707, 708 may extend outward (e.g. perpendicularly or orthogonally) from the main portion of the housing, such that corresponding faces 707, 708 on the power end housing 413 and the fluid end housing 323 may extend approximately in parallel when the power end housing 413 and the fluid end housing 323 are in contact (e.g. with corresponding flanges/face 707, 708 abutting). In some embodiments, the faces/flanges 707, 708 may extend in all directions around the housing. And while FIG. 7 illustrates an embodiment having two bolts (e.g. on opposing sides of the housing), additional bolts may be used in other embodiments. While bolts are shown in FIG. 7, various sorts of mechanical coupling devices may be used, all of which are included herein.

Some embodiments may further comprise a housing (e.g. joint) seal 750 disposed between the power end housing 413 and the fluid end housing 323 (e.g. at the joint between the corresponding faces 707, 708). The housing seal 750 may be configured to seal the joint therebetween, for example providing a sealed coupling of the power end housing 413 to the fluid end housing 323 and/or of the power end bore 420 to the fluid end bore 720. In embodiments, the housing seal 750 can be configured to seal the fluid connection/coupling between the power end bore 420 and the fluid end bore 720, for example to form the unitary sealed pump bore 712 (e.g. preventing leakage from escaping at the joint between the power end housing 413 and the fluid end housing 323). For example, the housing seal 750 may include one or more o-ring seal, metallic seal ring, and/or gasket, which may encircle the pump bore (e.g. at the intersection of the faces 707, 708). In some embodiments, there may be an inset in one or both corresponding faces/flanges 707, 708 at the joint, and the housing seal 750 may be disposed therein.

In embodiments, the power end bore 420 and the fluid end bore 720 may have contacting open ends aligning (e.g. when the corresponding faces 707, 708 are coupled in contact/abutting). In FIG. 7, the power end bore 420 and the fluid end bore 720 align (e.g. have longitudinal centerline axes which align). In embodiments, the bellows 330 can be configured to extend/expand parallel to the power end bore 420 and/or fluid end bore 720 (e.g. the bellows 330 may have a longitudinal centerline axis which aligns with the longitudinal centerline axis of the power end bore 420 and/or the fluid end bore 720). For example, in FIG. 7, the pump 300 has a linear configuration, in which the longitudinal centerline axis of the power end bore 420, the fluid end bore 720, the bellows 330, and the chamber 321 are all aligned. In the embodiment of FIG. 7, the chamber 321 and/or fluid end housing 323 may also include a valve port 775 (e.g. a single point of fluid connection) configured to be in fluid communication with both the suction valve 326 and the discharge valve 328 (e.g. providing fluid communication between the suction and discharge valves 326, 328 and the chamber 323). In FIG. 7, the single valve port 775 is aligned with the longitudinal centerline of the chamber 321 and/or bellows 330 and/or fluid end bore 720 and/or power end bore 420.

As previously discussed, the power end 310 can be configured with two drive ports (e.g. a first port 432 and a second port 434), for example with the first port 432 configured to inject fluid in order to drive the piston 410 towards the bellows 330 (e.g. towards the fluid end bore 720), and the second port 434 configured to inject fluid in order to drive the piston 410 away from the bellows 330 (e.g. away from the fluid end bore 720). In embodiments, the first port 432 and the second port 434 may be operated in conjunction to induce reciprocal movement of the piston 410 in the bore 420, for example with one port injecting fluid while the other port removes fluid. In embodiments, the first port 432 can be in fluid communication with the first cavity 422*a* of the bore 420, and the second port 434 can be in fluid communication with the second cavity 422*b* of the bore 420. Some pump embodiments may further include a hydraulic circuit fluidly coupled to the two drive ports (e.g. the first port 432 and the second port 434), which may be configured to inject and remove fluid therethrough to drive the piston 410.

As also discussed above, the piston 410 may have a head 412 and a rod 414, for example with the rod 414 extending away from the head 412 towards the bellows 330 (e.g. the fluid end 320). In embodiments, the rod 414 and the head 412 may have longitudinal centerline axes which are aligned (and which may also be aligned with the axis for the power end bore 420). In embodiments, the head 412 can be disposed between the first port 432 and the fluid end 320, and the second port 434 can be disposed between the head 412 and the fluid end 320 (e.g. such that the head 412 may move between the two ports based on fluid movement therethrough, which may generate pressure differentials on the head 412). Embodiments may further comprise a first seal 451 (e.g. a moving seal, for example disposed on the head 412) configured to allow the head 412 to sealingly move (e.g. reciprocate) within the power end bore 420 (e.g. within the first portion 422 of the power end bore 420), and a second seal 453 (e.g. a stationary seal/packing, for example disposed in either the power end bore 420 or the fluid end bore 720) configured to allow the rod 414 to sealingly move (e.g. reciprocate) within the bore.

In embodiments, the head 412 can have a larger diameter/cross-section than the rod 414, for example providing an intensifying effect configured to apply more pressure to the bellows 330. For example, the piston 410 may be part of an intensifier (e.g. the power end 310 may be configured as an intensifier). In exemplary embodiments, the rod-to-head size may range from approximately 1:1.1 to 1:10, for example. And as previously discussed, the bore 420 can include a first portion 422 configured for movement of the head 412 (e.g. axially) therethrough (e.g. having a diameter sized for the head 412) and a second portion 424 configured for movement of the rod 414 (e.g. axially) therethrough (e.g. having a diameter sized for the rod 414).

Some embodiments may further comprise a make-up port 515, which may be in fluid communication with the power end bore 420 and/or the fluid end bore 720. The make-up port 515 may be configured to be fluidly coupled to a make-up system which is configured to keep the piston 410 and bellows 330 in sync and/or to maintain a controlled volume of fluid between the piston 410 (e.g. rod 414) and the bellows 3330 (e.g. in the third cavity of the bore), for example by allowing for injection of fluid into or removal of fluid from between the piston rod 414 and the bellows 330. In embodiments, the make-up port 515 can extend (e.g. radially) from either the power end bore 420 or the fluid end bore 720 to the exterior of the housing. In embodiments, the make-up port 515 can be disposed between the second seal 453 and the bellows 330 (e.g. in either the power end bore 420 or the fluid end bore 720), for example providing fluid communication between the bellows 330 and the make-up system for maintaining the controlled volume of fluid between the second seal 453 and the bellows 330.

Figure 8:
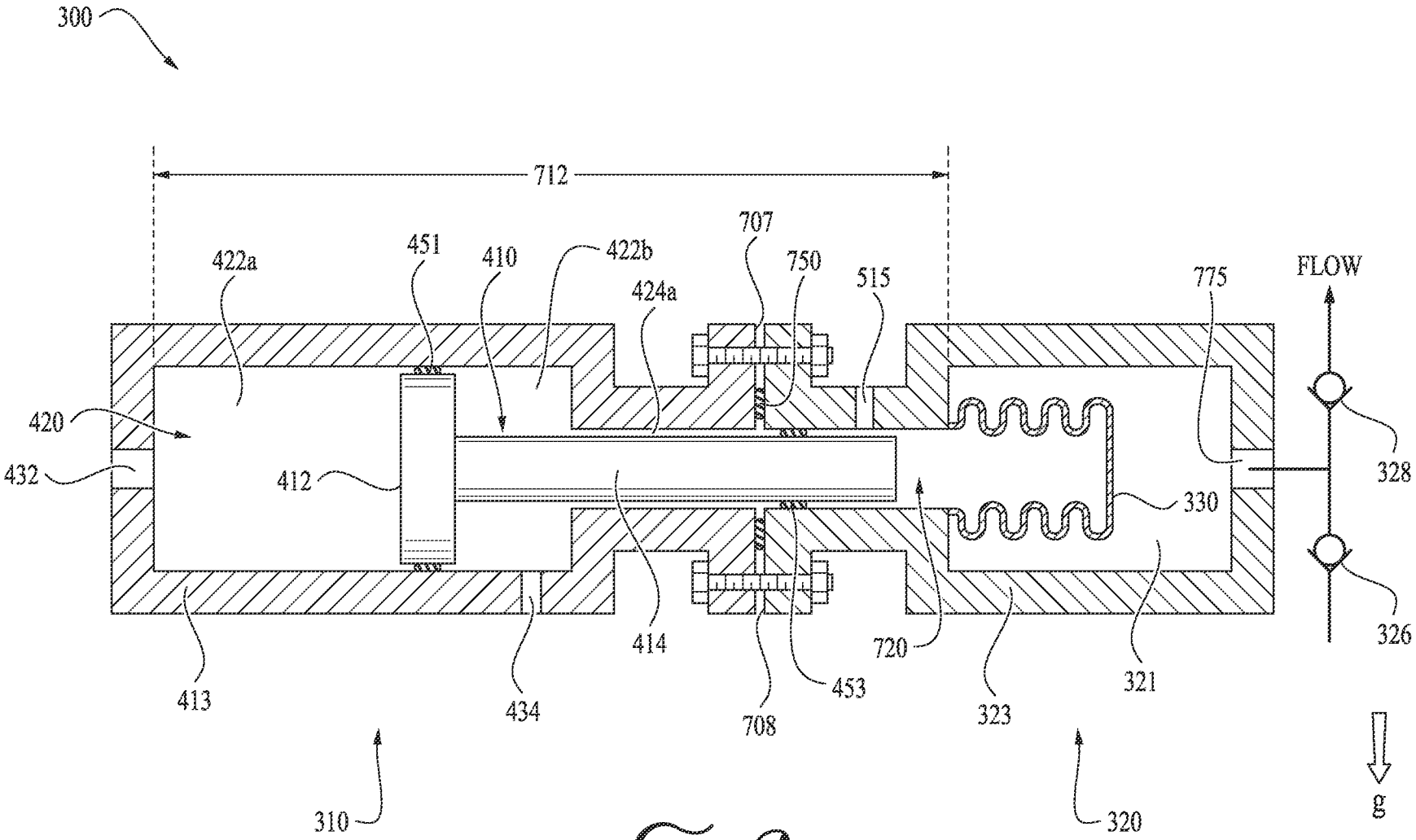
FIG. 8 is a cross-sectional view of another exemplary piston-driven bellows pump, according to an embodiment of the disclosure.

In the embodiment of FIG. 7, the make-up port 515 is disposed in the power end 310 (e.g. extending through the power end housing 413 and in fluid communication with the power end bore 420), and the make-up port 515 is disposed between the second seal 453 and the bellows 330 (e.g. with the second seal 453 disposed in the second portion 424 of the power end bore 420 and/or in proximity to the first portion 422 of the power end bore 420). FIG. 8 illustrates an exemplary embodiment similar to FIG. 7, having the make-up port 515 disposed in the fluid end 320 (e.g. extending through the fluid end housing 323 and in fluid communication with the fluid end bore 720). While the second seal 453 could still be located in the power end bore 420, in FIG. 8 the second seal 453 is disposed in the fluid end 320 (e.g. in the fluid end bore 720). For example, the second seal 453 can be disposed between the make-up port 515 and the joint between the fluid end housing 323 and the power end housing 413 (e.g. between the make-up port 515 and the housing seal 750 and/or between the make-up port 515 and the face/flange 708 of the fluid end 320). In embodiments, the make-up port 515 can be disposed between the second seal 453 and the bellows 330. Advantageously, in the configuration shown in FIG. 8 (e.g. with the make-up port 515 in the fluid end 320 and the second seal 453 in the fluid end bore 720, between the make-up port 515 and the joint), the housing seal 750 and/or the joint may be shielded from high pressure (e.g. the higher pressure within the bellows 330) by the second seal 453 (e.g. such that the housing seal 750 may only be exposed to the lower pressure from the first portion 422 of the bore 420, and may not be exposed to the higher pressure of the bellows 330). This shielding effect may improve the lifespan and/or reliability of the housing seal 750 and/or may allow for use of a housing seal 750 which is not rated for higher pressures (such as bellows 330 pressures). Furthermore, locating the second seal 453 in the fluid end bore 720 may minimize unswept volume between the rod 414 and the bellows 330, improving efficiency. In some embodiments, the second seal 453 may be disposed as close to the bellows 330 as possible (e.g. proximate the bellows 330), while still having the make-up valve 515 disposed between the second seal 453 and the bellows 330.

In some embodiments, low pressure for the treatment fluid may range up to about 1000 psi (e.g. about 0-1000 psi, about 100-1000 psi, about 300-1000 psi, about 500-1000 psi, about 750-1000 psi, about 0-750 psi, about 100-750 psi, about 300-750 psi, about 0-500 psi, about 100-500 psi, or about 500-750 psi). In some embodiments, high pressure for the treatment fluid may range from about 1000 psi to about 15,000 psi, from about 1000 psi to about 20,000 psi, from about 15,000 psi to about 20,000 psi, from about 3000 psi to about 15,000 psi, from about 3000 psi to about 20,000 psi, from about 5000 psi to about 15,000 psi, or from about 5000 psi to about 20,000 psi. In embodiments, the hydraulic driver fluid pressure may range up to about 5000 psi (e.g. about 0-5000 psi, about 100-5000 psi, about 500-5000 psi, or about 1000-5000 psi), or in some embodiments up to about 10,000 psi (e.g. about 0-10,000 psi, about 100-10,000 psi, about 500-10,000, or about 1000-10,000 psi).

Figure 9:
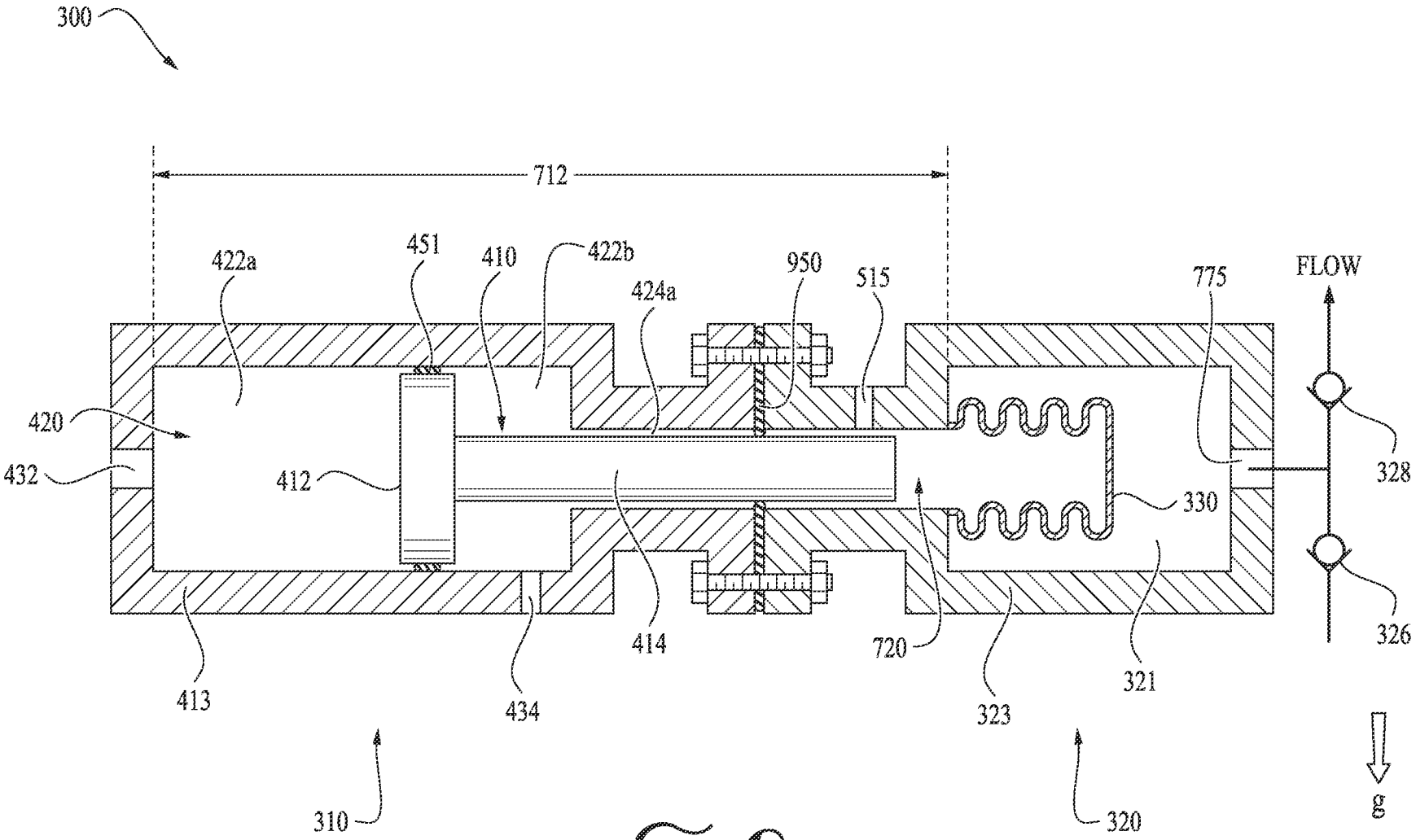
FIG. 9 is a cross-sectional view of yet another exemplary piston-driven bellows pump, according to an embodiment of the disclosure.

In some embodiments, the second seal 453 can be disposed proximate to the housing seal, 750 for example within the fluid end bore 720 or the power end bore 420. Proximity to the joint may allow for easier inspection and/or maintenance. In some embodiments, the second seal 453 can be axially aligned with the housing seal 750 and/or can be disposed at the joint (e.g. at faces 707, 708). For example, the housing seal 750 and the second seal 453 may be jointly formed (e.g. a unitary seal 950 can be configured for both functions, sealing the joint and allowing for sealing movement of the rod 414). FIG. 9 illustrates an embodiment which may be similar to FIGS. 7-8, having a single unitary seal 950 (e.g. disposed between the power end 310 and the fluid end 320 and/or between faces 707, 708) configured to perform both the sealing function of the housing seal and the sealing function of the second seal. The unitary seal 950 may extend into the bore and at least partially between the faces 707, 708.

Figure 10:
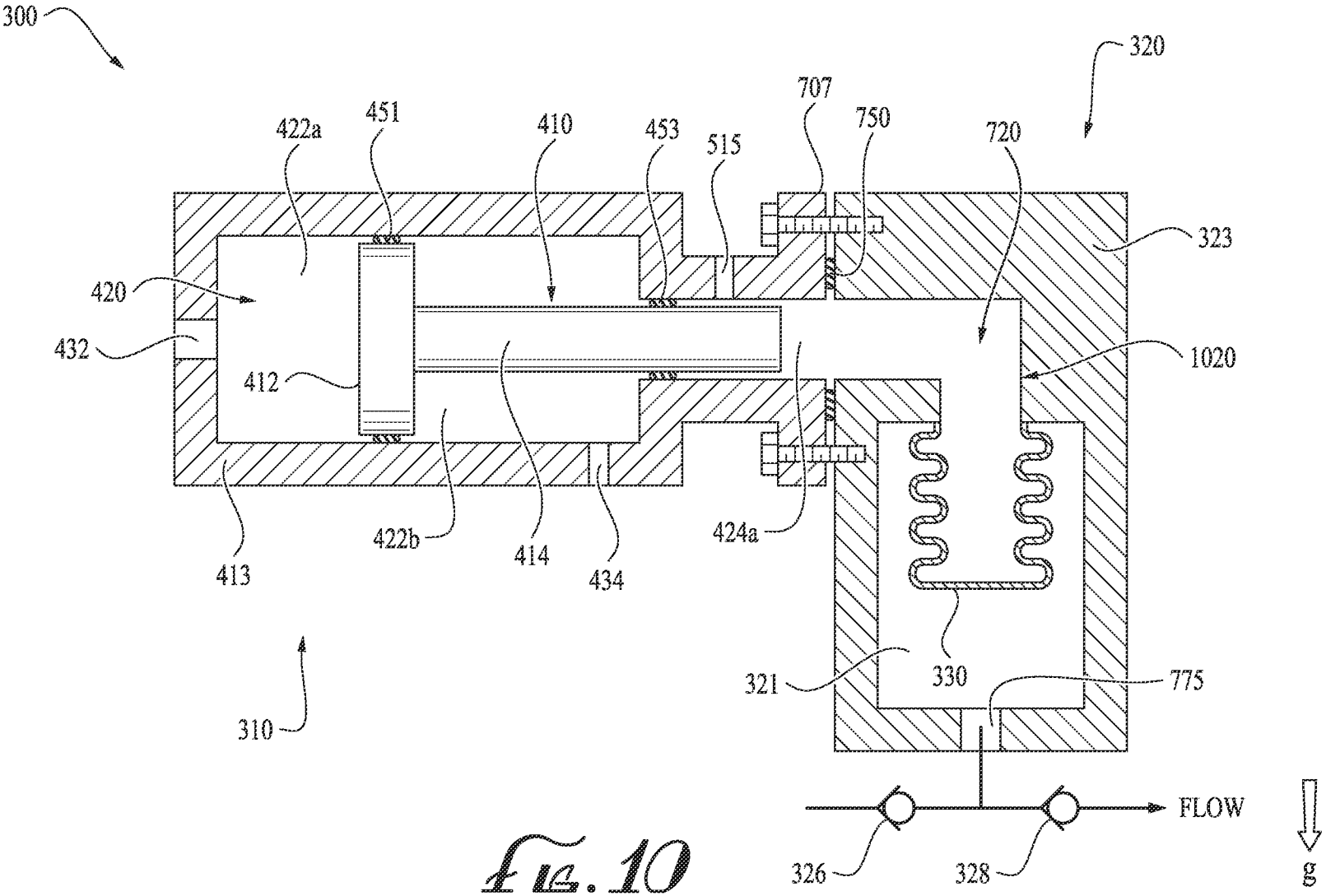
FIG. 10 is a cross-sectional view of still another exemplary piston-driven bellows pump, according to an embodiment of the disclosure.

In some embodiments, the fluid end bore 720 can include an angled portion 1020 (which could in some embodiments be the entire fluid end bore 720), which is in fluid communication with the power end bore 420 but not aligned with the power end bore 420 (e.g. extends in a direction angled from the longitudinal centerline axis of the power end bore 420, with the longitudinal centerline axis of the angled portion 1020 of the fluid end bore 720 extending at an angle from (e.g. not parallel to) the longitudinal centerline axis of the power end bore 420). FIG. 10 illustrates an embodiment similar to FIGS. 7-9, in which a portion 1020 of the fluid end bore 720 is not parallel to the power end bore 420. In embodiments, the bellows 330 may be configured to expand in a direction angled from the power end bore 420 (e.g. from the longitudinal centerline axis of the power end bore 420). For example, the longitudinal centerline axis of the bellows 330 may be angled from (e.g. not parallel with) the longitudinal centerline axis of the power end bore 420 (for example, with the bellows 330 axis being parallel with and/or aligned with the longitudinal centerline axis of the angled portion 1020 of the fluid end bore 720).

In embodiments, the chamber 321 may be configured with its longitudinal centerline axis angled from (e.g. not parallel with) the longitudinal centerline axis of the power end bore 420. In embodiments, the bellows 330 may be configured to expand at an angle to the power end bore 420 (e.g. with the direction of expansion angled from the longitudinal centerline axis of the power end bore 420) and/or the longitudinal centerline axis of the bellows 330 may be angled from the longitudinal centerline axis of the power end bore 420. In FIG. 10, the angle (e.g. of the angled portion 1020 of the fluid end bore 720 and/or bellows 330 expansion and/or the chamber 321) is approximately 90 degrees from (e.g. orthogonal and/or perpendicular to) the power end bore 420 (e.g. the longitudinal centerline of the power end bore 420). In other embodiments, any angle could be used.

As shown in FIG. 10, the bellows 330 may be configured to expand downward (e.g. with respect to gravity (g)). For example, the power end bore 420 may be approximately horizontal, while the chamber 321 may extend and the bellows 330 may be configured to expand approximately vertically with respect to gravity (e.g. downward). In embodiments, fluid communication between the suction and discharge valves 326, 328 and the chamber 321 (e.g. the one or more valve port 775) may be disposed below (e.g. with respect to gravity) the bellows 330. Locating the suction and discharge valves 326, 328 below the bellows 330 may reduce accumulation of solids (e.g. sand) from the treatment fluid on the convolutions (e.g. pleats or folds) of the bellows 330, which may improve bellows 330 function and/or durability.

Figure 11:
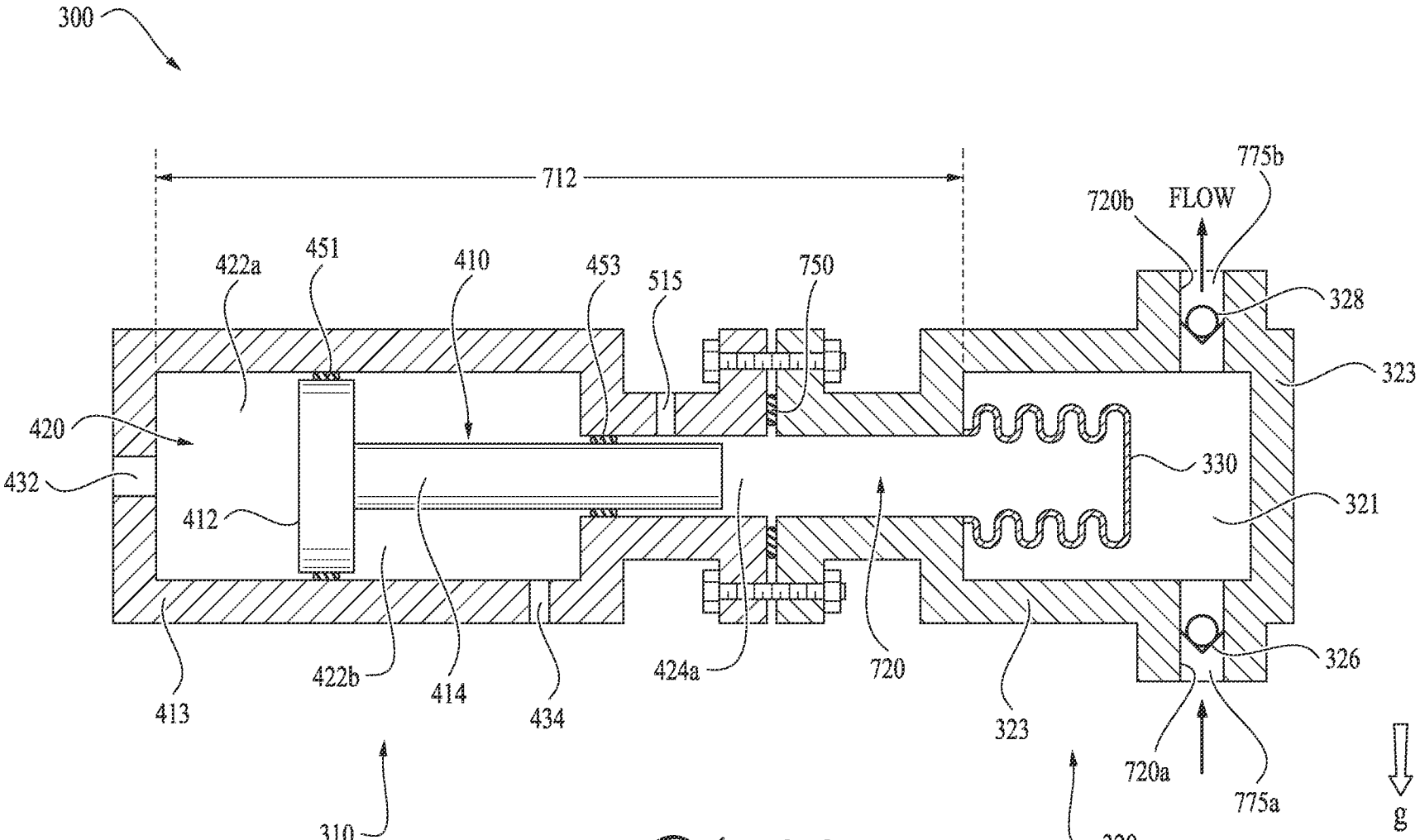
FIG. 11 is a cross-sectional view of yet another exemplary piston-driven bellows pump, according to an embodiment of the disclosure.
Figure 12:
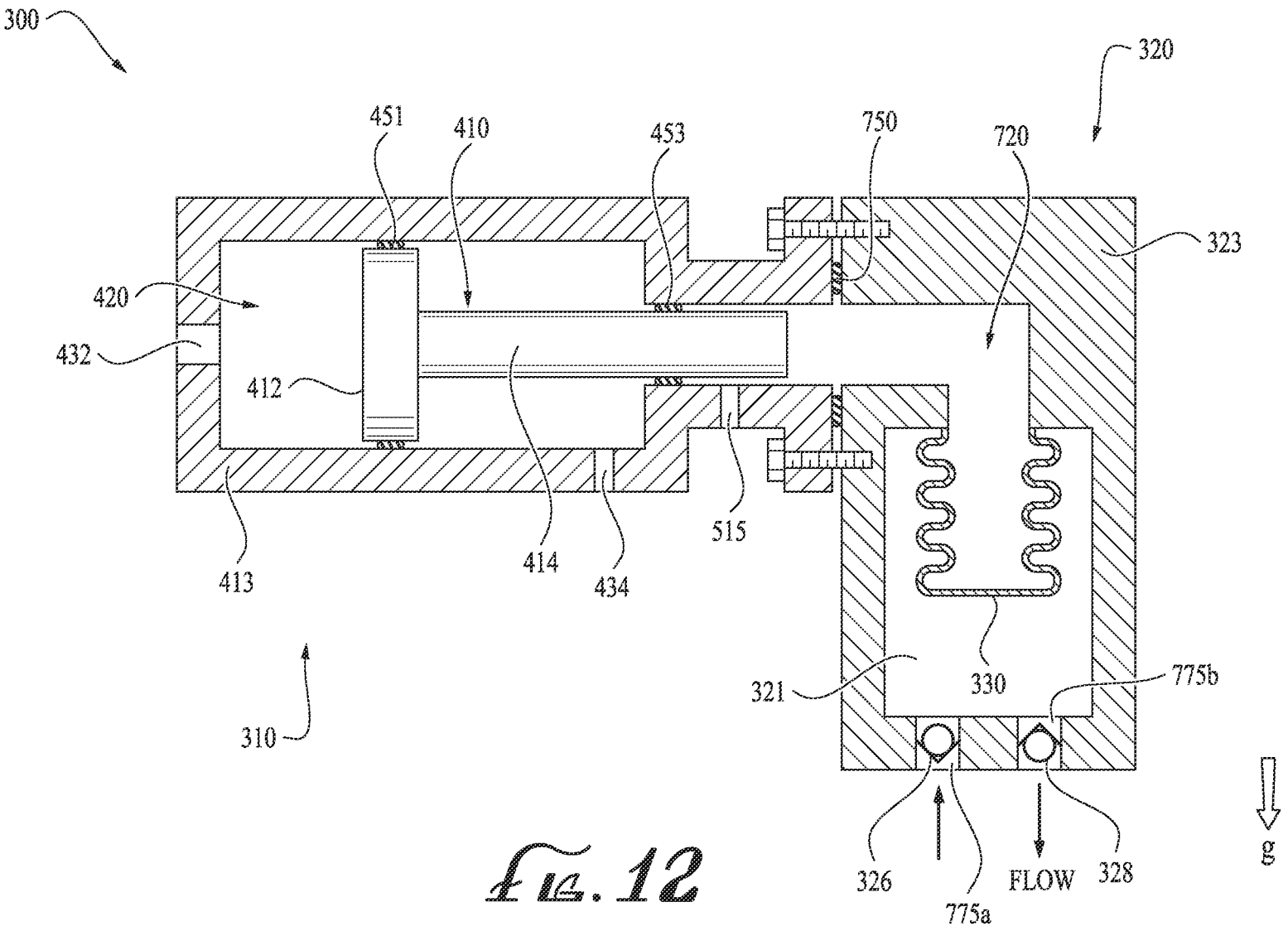
FIG. 12 is a cross-sectional view of still another exemplary piston-driven bellows pump, according to an embodiment of the disclosure.

In embodiments, the suction valve 326 and/or the discharge valve 328 can be integrated into the fluid end housing 323. For example, the fluid end housing 323 can include two valve ports 775*a*, 775*b*, which can be in fluid communication with the chamber 321, and which may have the suction valve 326 and discharge valve 328 disposed therein. As shown in FIG. 11 (which may be similar to the embodiments shown in FIGS. 7-9), the suction valve 326 can be disposed opposite the discharge valve 328 in the chamber 321, in some embodiments. For example, the valve ports 775*a*, 775*b* can be disposed on opposite sides of the chamber 321. As shown in FIG. 12 (which may be similar to the embodiment shown in FIG. 10), the suction valve 326 and the discharge valve 328 can be disposed on the same side of the chamber 321/fluid end housing 323, in some embodiments. For example, the two valve ports 775*a*, 775*b* can be disposed on the same side of the chamber 321. In embodiments, the suction valve 326 and the discharge valve 328 can both be disposed below (e.g. with respect to gravity (g)) the bellows 330. For example as shown in FIG. 12, both valve ports 775*a*, 775*b* can be disposed below the bellows 330. In embodiments, as the bellows 330 extends/expands (e.g. during a discharge stroke), it can extend/expand downward towards the suction and discharge valves 326, 328.

Figure 13:
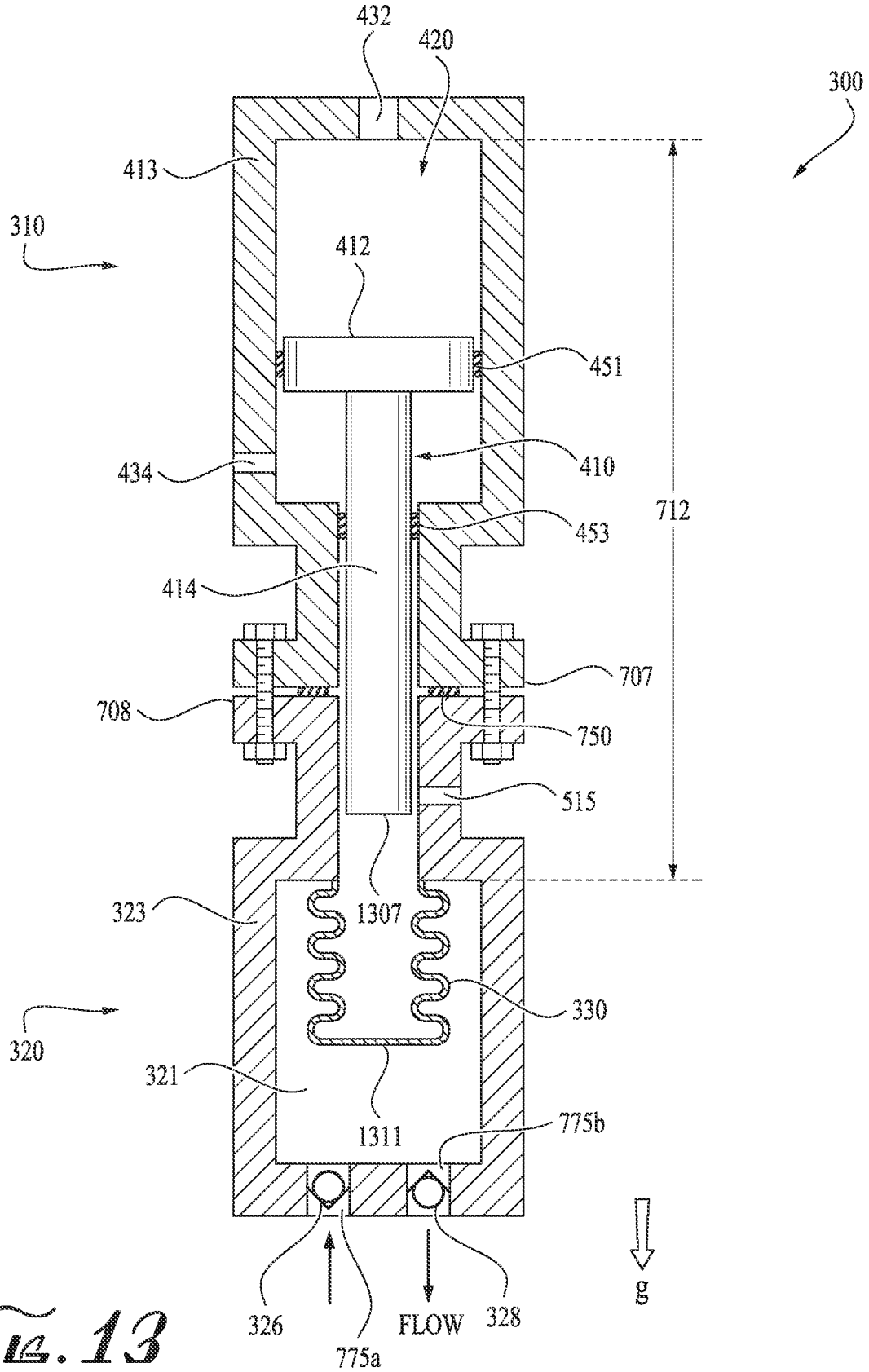
FIG. 13 is a cross-sectional view of yet another exemplary piston-driven bellows pump, according to an embodiment of the disclosure.

In some embodiments, the bellows 330 may be configured to expand downward (e.g. with respect to gravity), for example during a discharge stroke of the pump 300. As shown in FIG. 13, this can be because of the orientation of the pump 300 (e.g. with the pump 300 oriented so that the bellows 330 expands downward with respect to gravity (g)), and/or it may be because of the orientation of the bellows 330 with respect to the power end 310 (e.g. as shown in FIG. 12, with the fluid end bore 720 having an angled portion 1020). In some embodiments, the chamber 321 can be configured so that fluid connection to the suction and discharge valves 326, 328 is located below the bellows 330 (with respect to gravity).

In some embodiments, the piston 410 (e.g. the rod 414) may be configured to only extend in the power end bore 420 (e.g. with the second seal 453 disposed in the power end bore 420). For example, the rod 414 may not extend into the fluid end bore 720, even on the discharge stroke. In other embodiments, the piston 410 can extend through both the power end bore 420 and the fluid end bore 720. For example, the rod 414 can be configured to extend into the fluid end bore 720 (e.g. at least during the discharge stroke). While in some embodiments, the rod 414 may extend into the fluid end bore 720 during discharge strokes and retract out of the fluid end bore 720 during suction strokes, in other embodiments a distal end 1307 of the rod 414 (e.g. the end of the rod 414 closest to the bellows 330) can be configured to remain in the fluid end bore 720 throughout reciprocal movement of the piston 410 (e.g. during both discharge and suction strokes). In some embodiments, the distal end 1307 of the rod 414 never exits/retracts out of the fluid end bore 720, for example with the distal end 1307 of the rod 414 reciprocally moving within the fluid end bore 720 alone. In such embodiments, the second seal 453 can be disposed in the fluid end bore 720. In some embodiments, the distal end 1307 of the rod 414 may not extend into the bellows 330 (e.g. on a discharge stroke). In other embodiments, the distal end 1307 of the rod 414 may partially extend into the bellows 330. For example, the distal end 1307 of the rod 414 may extend into the bellows 330 during the discharge stroke, but may be configured to not contact a distal end 1311 of the bellows 330 (e.g. the end of the bellows 330 extending furthest into the chamber 321 and/or away from the rod 414). For example, the controlled volume of fluid can be configured to prevent the distal end 1307 of the rod 414 from contacting the distal end 1311 of the bellows 330.

Figure 14:
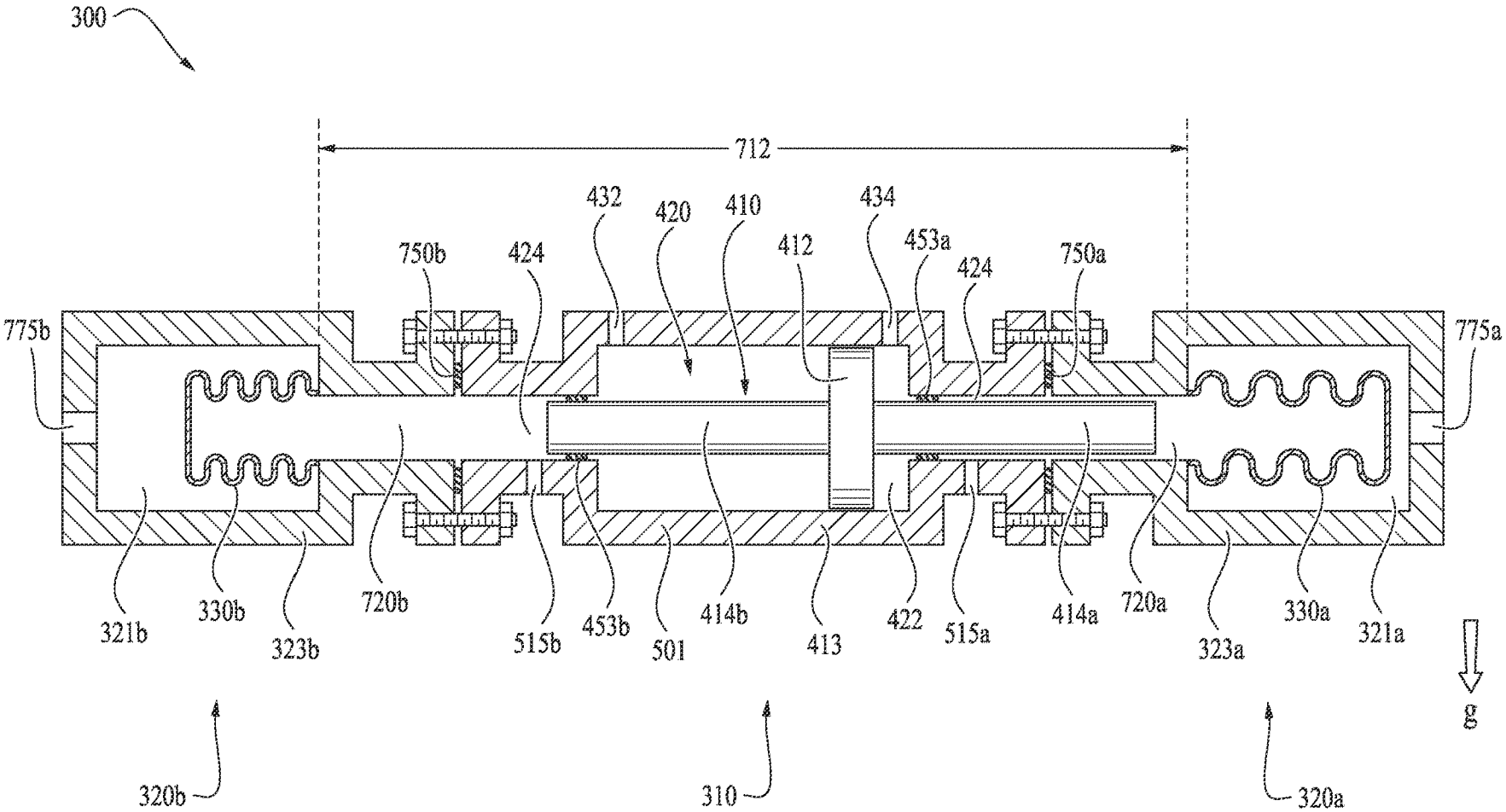
FIG. 14 is a cross-sectional view of an exemplary dual bellows (e.g. double-acting) pump, according to an embodiment of the disclosure.

While the embodiments described above illustrate single bellows pumps, aspects may also apply to dual bellows pump embodiments. For example, FIG. 14 illustrates an exemplary dual bellows pump embodiment, which may be similar to FIGS. 7-9, 11, and 13, and further comprising a second fluid end 320*b*. For example, the second fluid end 320*b* may have a second fluid end bore 720*b* and a second chamber 321*b* (e.g. both in the second fluid end housing 323*b*) in fluid communication with a second suction valve 326*b* and a second discharge valve 328*b*. In some embodiments, the second fluid end 320*b* may be substantially the same as the first fluid end 320*a* (e.g. which may be substantially the same as the fluid end embodiments 320 described herein). A second expandable bellows 330*b* may be disposed in the second chamber 321*b*. A second make-up port 515*b* may be disposed in the second fluid end housing 323*b* or in the power end housing 413. The power end bore 420 can be fluidly coupled to (e.g. in fluid communication with) both the first and second fluid end bores 720*a*, 720*b* (e.g. with the power end bore 420 extending out of two sides of the power end housing 413, for example with two second portions (e.g. configured for the rod) of the power end bore 420 extending from a single first portion (e.g. configured for the head) of the power end bore 420), for example forming the unitary pump bore 712 without external piping therebetween. The unitary pump bore 712 may be entirely disposed within the power end housing 413 and the two fluid end housings 323*a*, 323*b* due to direct contact of the housings and/or may consisting essentially of the power end bore 420 and the two fluid end bores 720*a*, 720*b*. In some embodiments, there may be no unswept volume between the power end bore 420 and the two fluid end bores 720*a*, 720*b* (e.g. minimizing unswept volume between the piston 410 and the two bellows 330*a*, 330*b*).

The power end 310 can be configured to reciprocally expand and contract both the first and second bellows 330*a*, 330*b* based on movement of fluid by the piston 410. For example, the piston 410 may have a head 412 and two rods 414*a*, 414*b*, with the rods 414*a*, 414*b* extending from opposite sides of the head 412 (e.g. with the first rod 414*a* extending towards the first fluid end 320*a*/bellows 330*a* and the second rod 414*b* extending towards the second fluid end 320*b*/bellows 330*b*). In some embodiments, the two rods 414*a*, 414*b* may be aligned (e.g. having the same longitudinal centerline axis) and/or may extend outward along the centerline axis of the head 412 and/or first portion 422 of the power end bore 420. Embodiments may further include a second housing (e.g. joint) seal 750*b* disposed between the power end housing 413 and the second fluid end housing 323*b* (e.g. such that the pump 300 has two housing seals (750*a*, 750*b*), with a housing seal disposed between the power end housing 413 and each of the two fluid end housings 323*a*, 323*b*). The second housing seal 750*b* may be configured to seal the joint between the power end housing 413 and the second fluid end housing 323*b* and/or to seal the fluid connection/coupling between the power end bore 420 and the second fluid end bore 720*b* (e.g. preventing leakage from escaping at the joint between the housings).

Figure 15:
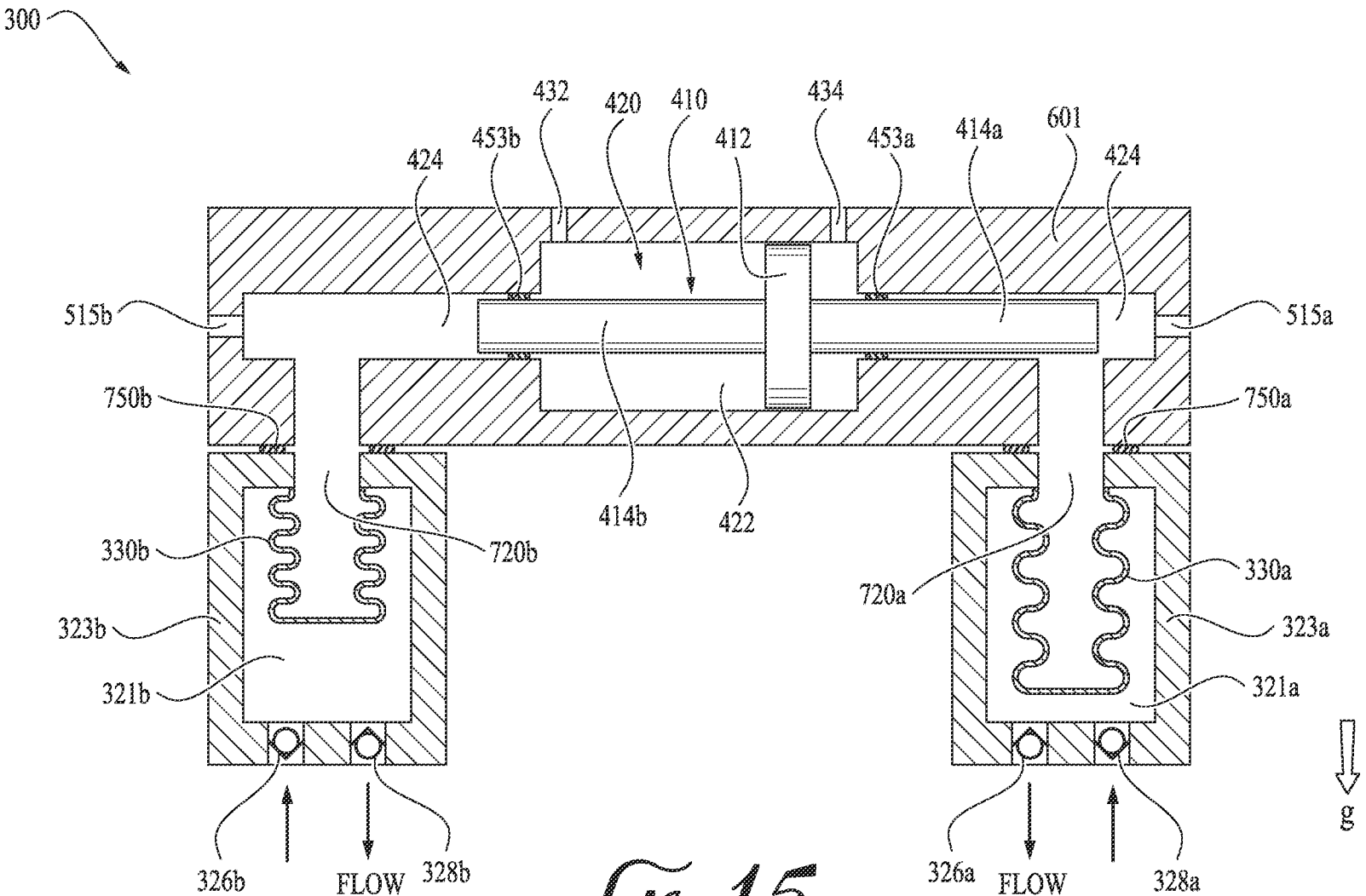
FIG. 15 is a cross-sectional view of another exemplary dual bellows (e.g. double-acting) pump, according to an embodiment of the disclosure.

FIG. 15 illustrates a similar dual bellows pump embodiment which is not linear. In some embodiments, one or both of the first and second fluid end bore 720*a*, 720*b* can include an angled portion (which could in some embodiments be the entire fluid end bore), which is in fluid communication with the power end bore 420 but not aligned with the power end bore 420 (e.g. extends in a direction angled from the longitudinal centerline axis of the power end bore 420—with the longitudinal centerline axis of the angled portion of the fluid end bore(s) 720*a*, 720*b* extending at an angle from (e.g. not parallel to) the longitudinal centerline axis of the power end bore 420). In some embodiments, one or more of the bellows 330*a*, 330*b* may be configured to expand in a direction angled from the power end bore 420 (e.g. from the longitudinal centerline axis of the power end bore). In some embodiments, one or more of the bellows 330*a*, 330*b* may be configured to expand in a direction angled from the longitudinal centerline axis of the piston 410. In some embodiments, one or more of the power end bore 420 may include an angled portion (e.g. angled from the longitudinal centerline axis of the piston 410), and the corresponding fluid end bore 720*a, b* may be configured to extend parallel to (e.g. in the same direction as) the angled portion of the power end bore 420 and/or the corresponding bellows 330*a, b* may be configured to expand in the same direction as (e.g. along the centerline axis of) the angled portion of the power end bore 420. In other aspects, the embodiment of FIG. 15 may be similar to FIG. 10 and/or FIG. 12 (e.g. but applied to a dual bellows pump).

Figure 16:
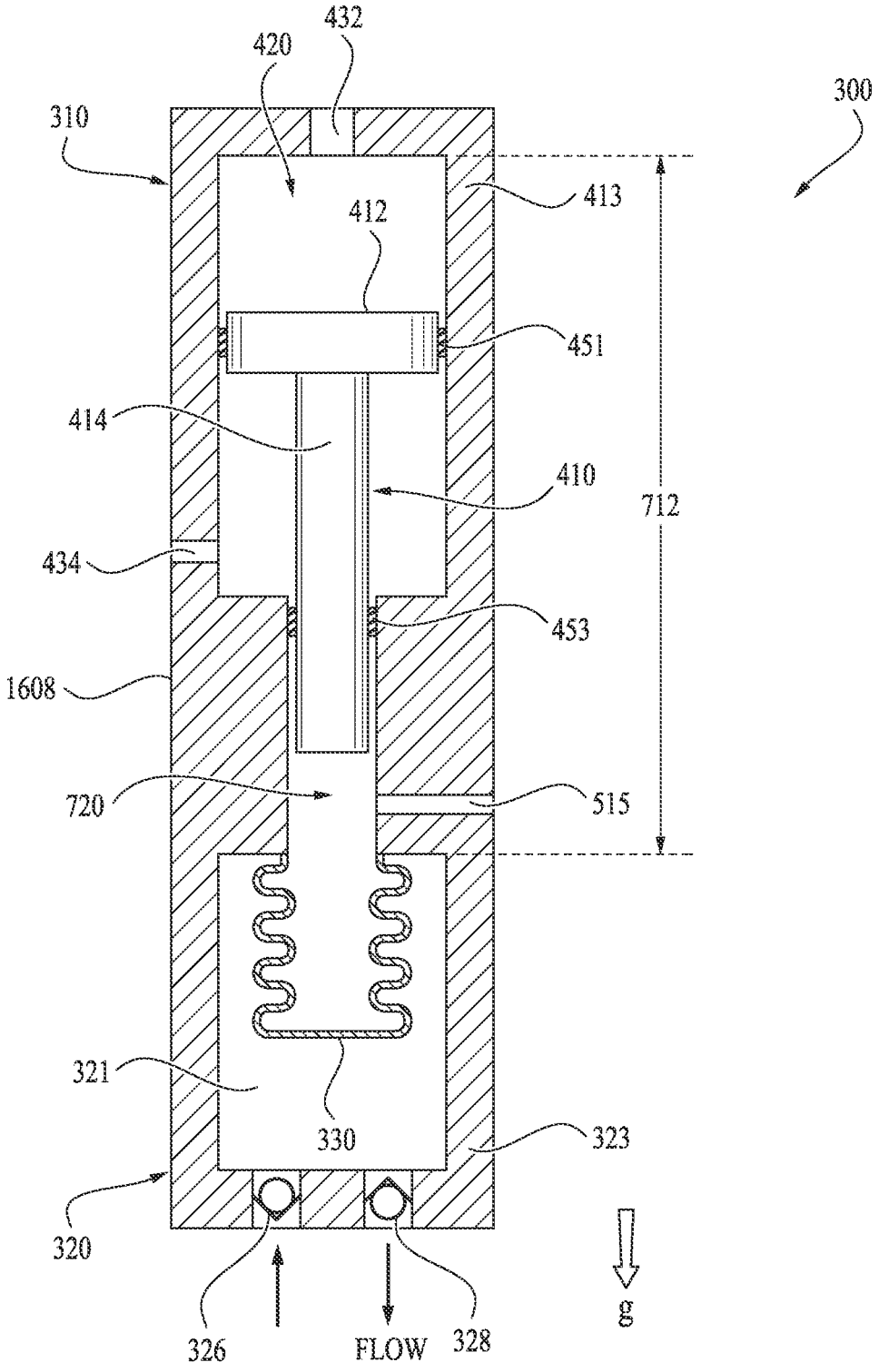
FIG. 16 is a cross-sectional view of another exemplary piston-driven bellows pump, according to an embodiment of the disclosure.

In some embodiments, the pump housing may not be formed by coupling a separate power end housing 413 to one or more fluid end housing(s) 320, but may be a unitary/monolithic housing 1608 (e.g. a single, solid piece) configure to include both the power end 310 and fluid end(s) 320. FIG. 16 illustrates an exemplary embodiment having a unitary/monolithic housing 1608. In embodiments, the power end bore 420 and the fluid end bore 720 can be fluidly coupled without external piping therebetween by the power end bore 420 and the fluid end bore 720 contacting (e.g. with open ends aligning and/or as part of a continuous bore) to form the continuous, unbroken, and/or unitary pump bore 712 (which consists essentially of the power end bore 420 and the fluid end bore 720). In other words, there may be only a single housing 1608 (e.g. a single piece) and a single bore 712 in some embodiments. In embodiments, the power end 310 and the fluid end(s) 320 may both be disposed within a common housing (e.g. within a unitary housing 1608, which may be machined from a single piece of metal, for example). For example, the power end housing 413 and the one or more fluid end housing 323 may be portions of the unitary/common housing 1608. Since there is no joint between separate housing elements, there may be no (e.g. housing) seal between the power end 310 and the fluid end 320 necessary to form the unitary, sealed pump bore 712, which is entirely disposed within the common/unitary housing 1608. This unitary housing approach may be used for dual bellows pumps as well, and the embodiment of FIG. 16 may be similar to any of FIGS. 7-15 in one or more aspects. In some embodiments, there may not be a fluid bore. For example, the bellows 330 may directly couple to the power end bore 420 in some embodiments. In embodiments, the bellows 330 may be disposed at the open end/corresponding face of the fluid end 320. Variations of all disclosed embodiments with no fluid bore and with the bellows 330 directly coupled to the power end bore 420 are included herein. As persons of skill will appreciate, various aspects illustrated in one or more of the disclosed embodiments may be combined and/or deleted, thereby illustrating still further disclosed embodiments included within the scope of this disclosure.

While the suction valve 326 and the discharge valve 328 may each be one-way check valves, in alternate embodiments, any other suitable valve may be used as either the suction valve 326 and/or discharge valve 328. Although not required, the bellows pump 300 may be coupled to a pressure intensifier (e.g. having a piston 410 with head 412 larger than rod 414), which may be configured to increase the hydraulic pressure produced by the bellows pump 300. In embodiments, the pressure intensifier may be integrated into the bellows pump 300. It should be understood that various pump embodiments discussed with respect to a piston and/or intensifier may be used without the piston and/or intensifier in other embodiments (e.g. with alternate means or mechanisms for reciprocally expanding and contracting the bellows), all of which are specifically included herein. Additionally, any driver mechanism capable of reciprocally expanding and contracting the bellows 330 may be used, and are included within the scope of this disclosure.

The systems and methods described herein may be used in controlling an injection treatment (e.g. of treatment fluid into a well). For example, the injection treatment may be modified by utilizing a new intensifying-type pump that does not have piping between the main components. For example, this disclosure includes improved intensifier-type pumping system embodiments. In an embodiment, the intensifier-type pumping system may provide designed components that allow for directly coupling of various major components of an intensifier-type pumping system. Such arrangements may help improve fatigue characteristics. The pumping system can include a pressure intensifier and one or more fluid ends and corresponding bellows. Advantageously, such an intensifier-type pumping system may reduce the need for piping to interconnect a pressure intensifier, fluid end, and/or suction/discharge valving. That is, since such piping can be subjected to significant cyclical pressure-induced fatigue, it may wear faster and become a hazard (e.g. prone to leaks and/or other failures). The piping may also be subject to stress during transportation of such systems, which may cause unseen or unknown weaknesses within the piping (therefore elevating the potential for hazards during operation). In contrast, the disclosed embodiments may eliminate as much of the interconnecting piping as possible and achieve fluid-connectivity by directly joining system components together or incorporating them in a reduced number of housings. In doing so, stress from transportation and cyclical pressure can be better reduced, managed, or eliminated.

As indicated above, additional benefits can include improved system efficiency/performance, maintenance, Health/Safety/Environmental (HSE) impact, reliability, and packaging opportunities. Additionally or alternatively, performance may be improved via the reduction of the un-swept volume between the intensifier and fluid end because of the elimination of connecting piping and its related volume. For example, any un-swept volume in the volume of the piping must be compressed before the fluid end can begin working (and the compressibility of typical fluids is approximately 3% at 10,000 psi), so reducing the volume within piping connections can be a direct factor of system efficiency.

Additional benefits may include the improvements in maintenance, environmental benefits, safety, and reliability of the system. For example, maintenance may be enhanced by elimination of piping/fittings/adapters and associated connections, and through incorporation of unitized components. Environmental benefits can be realized by fewer potential leak points. Safety aspects can be enhanced by reducing connections to be made/broken during repairs, as well as reduced potential for high-pressure-injection type injuries from leaks. Moreover, elimination of piping and fittings may also increase system reliability, for example by reduction of fatigue-failure related downtime and related repairs.

Direct connection of the system or apparatus components can enable more compact packaging of such systems, which may be especially beneficial in applications that require system and device mobility. For example, such intensifier-type pumps may be utilized in applications such as oil and gas retrieval. That is, the pumps may be deployed at various well locations and utilized for pumping fluids such as slurry or sludge into or around the well in order to retrieve the oil or gas.

Returning to FIG. 7, a two-dimensional diagram illustrates an example of a pump 300 apparatus, according to one or more aspects of the present disclosure. More particularly, FIG. 7 shows a cross-sectional diagram of a pump 300 comprising a single-acting intensifier driving a single fluid end 320 (e.g. with a single bellows 330 therein). The pump 300 of FIG. 7 includes a pressure intensifier (or intensifier section, which may serve as the power end 310 in FIG. 7) and a fluid end 320. The power end 310 can include an intensifier body (e.g. power end housing 413) and piston element 410. The power end housing 413 may include a first opening (e.g. the distal end of the second portion of the power end bore 420, e.g. at the face/joint). In some embodiments, the first opening may extend from an exterior surface of the power end housing 413 (e.g. at face 707) to an internal cavity of the power end housing 413 (e.g. the first portion 422 of the power end bore 420), thereby defining a channel (e.g. the second portion 424 of the power end bore 420) between the first portion 422 of the power end bore 420 and the exterior of the power end housing 413. In some embodiments, the second portion 424 of the power end bore 420 may be round, for example having a constant diameter. In alternative embodiments, the second portion 424 of the power end bore 420 may be different shapes.

In some embodiments, the first opening may extend from a face 707 of the power end housing 413. The face 707 of FIG. 7 is shaped such that the power end housing 413 is able to mate with a corresponding face 708 of a fluid end 320, which is described below. In some embodiments, the face 707 may be flat and have a plurality of holes that allow for fasteners (such as bolts) to mechanically secure the power end housing 413 to the corresponding fluid end 320. Additionally or alternatively, the face 707 may have grooves or other features that allow for a gasket (e.g. housing seal 750) to be disposed between the face 707 and the corresponding fluid end 320, thereby allowing for a hermetic seal to be formed therebetween. In some embodiments, the face 707 may be of any shape or size that allows for a seal to be formed between the power end housing 413 and the corresponding fluid end 320. In an embodiment, a separate member containing port (e.g. a unified seal) may be placed between faces 707, 708 with seals to both faces. In embodiments, this member may be a spool and include flanges to facilitate fastening power end housing 413 to fluid end housing 323.

In some embodiments, the power end housing 413 may be formed of a single component such as a metal, alloy, plastic, or a combination thereof. In some embodiments, the fluid end housing 323 may be formed of a single component such as a metal, alloy, plastic, or a combination thereof. In some embodiments, the power end housing 413 may be formed by two or more components that are able to be mechanically secured together to form the power end housing 413. For example, a multi-component power end housing 413 may allow for easier maintenance. In some embodiments, the fluid end housing 323 may be formed by two or more components that are able to be mechanically secured together to form the fluid end housing 323. As another example, a single component power end housing 413 may provide improved strength. In some embodiments, the overall pump housing may be formed of a single component such as a metal, alloy, plastic, or a combination thereof (e.g. a monolithic housing, such as 1608 in FIG. 16). A single component overall pump housing (such as shown in FIG. 16, for example) may provide improved strength. In some embodiments, the overall pump housing may be formed by two or more components that are able to be mechanically secured together to form the overall pump housing. For example, the power end housing 413 and the fluid end housing 323 may be coupled together to jointly form the overall pump housing.

The piston element 410 of FIG. 7 is disposed at least partially within the power end housing 413 and includes a head 412 and a rod portion 414. The head 412 may have a larger area (e.g., diameter) than an area at the distal end of the rod portion 414 (e.g., diameter of the rod portion 414). The difference between the area at the proximal end of the head 412 and the area of the distal end of the rod 414 allows for pressure intensification. The exact value of the areas may be selected based on the application that the pump 300 will be deployed in. The piston element 410 is disposed within the power end housing 413, such that the rod portion 414 is at least partially disposed within the second portion 424 of the power end bore 420 and the head 412 is (e.g. entirely) disposed within the first portion 422 of the power end bore 420.

In some embodiments, the first portion 422 of the power end bore 420 of the power end housing 413 is cylindrically shaped, having the walls of the power end housing 413 define the first portion 422 of the power end bore 420. In other embodiments, the first portion 422 of the power end bore 420 may have different shapes defined by the walls of the power end housing 413. The head 412 of the piston element 410 can have a shape that is similar to the shape of the first portion 422 of the power end bore 420. For example, the head 412 may also be cylindrically shaped such that a pressure differential on either side of the head 412 within the first portion 422 of the power end bore 420 can cause the piston element 410 to be displaced or moved. In some embodiments, the head 412 may have grooves designed to hold one or more gaskets, or other features, that allow for the head 412 to create a traveling seal (e.g. a first seal 451) between the outer portion of the head 412 and the internal walls of the power end housing 413 (e.g. the first portion 422 of the power end bore 420).

As indicated above, in some embodiments, the cross-sectional area of the proximal end of the head 412 is larger than the cross-sectional area of the distal end of the of the rod portion 414. This area contrast allows for the intensification of the fluid pressure. In some embodiments, the area ratio may range from approximately 1.1:1 up to 10:1 depending on the available driver fluid pressure provided to first port 432, and the desired discharge pressure from the fluid end 320.

In some embodiments, piston element 410 may also include a seal (e.g. second seal 453), which may allow for sealed movement of the rod 414 and/or define a controlled volume of fluid. In some embodiments, the second seal 453 may be a traveling seal, for example disposed on the rod. In other embodiments, the second seal 453 may be fixed in the bore 420 (e.g. in the second portion 424 of the power end bore 420 or in the fluid end bore 720). In various embodiments, the seals may be metallic or elastomeric. In some embodiments, the seals may comprise a labyrinth seal. In embodiments, similar configurations or grooves may also be employed along portions of rod 414 to create a traveling seal between the outer portions of the rod portion 414 and the inner walls of the channel (e.g. the second portion 424 of the power end bore 420) within the power end housing 413. In this way, the piston 410 when disposed within the power end housing 413 may define a first cavity 422*a*, a second cavity 422*b*, and a third cavity 424*a*. For example, the first cavity 422*a* may be defined by the volume of space beyond the proximal end of the head 412, the second cavity 422*b* may be defined by the volume of space at the distal end of the head 414 (e.g., around the rod portion 414 which is within the internal cavity (e.g. within the first portion 422 of the power end bore) 420, and the third cavity 424*a* may be defined by the volume between the distal end of the rod portion 414 and the first opening/face 707 (or when the power end 310 is attached to the fluid end 420, the bellows 330).

The power end housing 413 may also include a first port 432, into which driving fluid (e.g., hydraulic oil) can be introduced to urge the piston element 410 toward the fluid end 320. The first port 432 allows for the driving fluid to be introduced into the first cavity 422*a*. In other words, the first port 432 extends through the outer wall of the power end housing 413 into the first cavity 422*a*. In some embodiments, the first port 432 may be located along any of the walls of the power end housing 413.

The power end housing 413 may also include a second port 434 into which fluid can be introduced to retract piston element 410 away from fluid end 320. The second port 434 allows for the driving fluid to be introduced into the second cavity 422*b*. In other words, the second port 434 extends through the outer wall of the power end housing 413 into the second cavity 422*b*. In some embodiments, the second port 434 may be located along any of the walls of the power end housing 413.

The power end housing 413 may also include a third port (e.g. the make-up port 515), as shown in FIG. 7. The make-up port 515 can be configured to allow for the movement of fluid into and out of an interior volume that is at least partially defined by the third cavity 424*a* (e.g. when the power end 310 is coupled to the fluid end 320, between the rod 414 and the bellows 330). In some embodiments, the make-up port 515 can extend into the second portion 424 of the power end bore 420 formed within the power end housing 413. The make-up port 515 may connect the exterior of the power end housing 413 to the third cavity 424*a*, for example, when the piston element 410 is moved away from the fluid end 320 (e.g., the first opening). In some embodiments, multiple make-up ports can be included and may be used to circulate fluid through the interior volume.

The fluid end 320 may include a fluid end housing 323 and a bellows 330, as shown in FIG. 7. In some embodiments, the fluid end housing 323 may be formed of a single component or multiple components. For example, the fluid end housing 323 may be formed of the same or similar material to the material used to form the power end housing 413. The fluid end housing 323 of FIG. 7 includes a first opening (e.g. the open end of the fluid end bore 720). In some embodiments, the fluid end housing 323 may include a face 708 that is structured to mechanically secure to the face 708 of the power end 310 as described above. That is, in various embodiments, the face 708 of the fluid end housing 323 may structurally correspond to the face 707 of the power end 310 such that the fluid end housing 323 and the power end 310 can be mechanically secured together directly. This direct connection eliminates the need for piping to connect the third cavity (e.g. the power end bore 420) to the first opening of the fluid end housing 323 (e.g. no piping need to connect the second portion 424 of the power end bore 420 to the fluid end bore 720). The corresponding face structures incorporated into the fluid end housing 323 and the power end housing 413 may allow for this direct mechanical and/or hermetic coupling.

The first opening of the fluid end housing 323 is structured such that the interior volume (e.g. controlled volume) is formed when the fluid end housing 323 is mechanically secured to the power end housing 413. The interior volume may be defined by the third cavity 424*a*, a channel (e.g. the fluid end bore 720) of the first opening of the fluid end housing 323, and the bellows 330.

Figure 3:
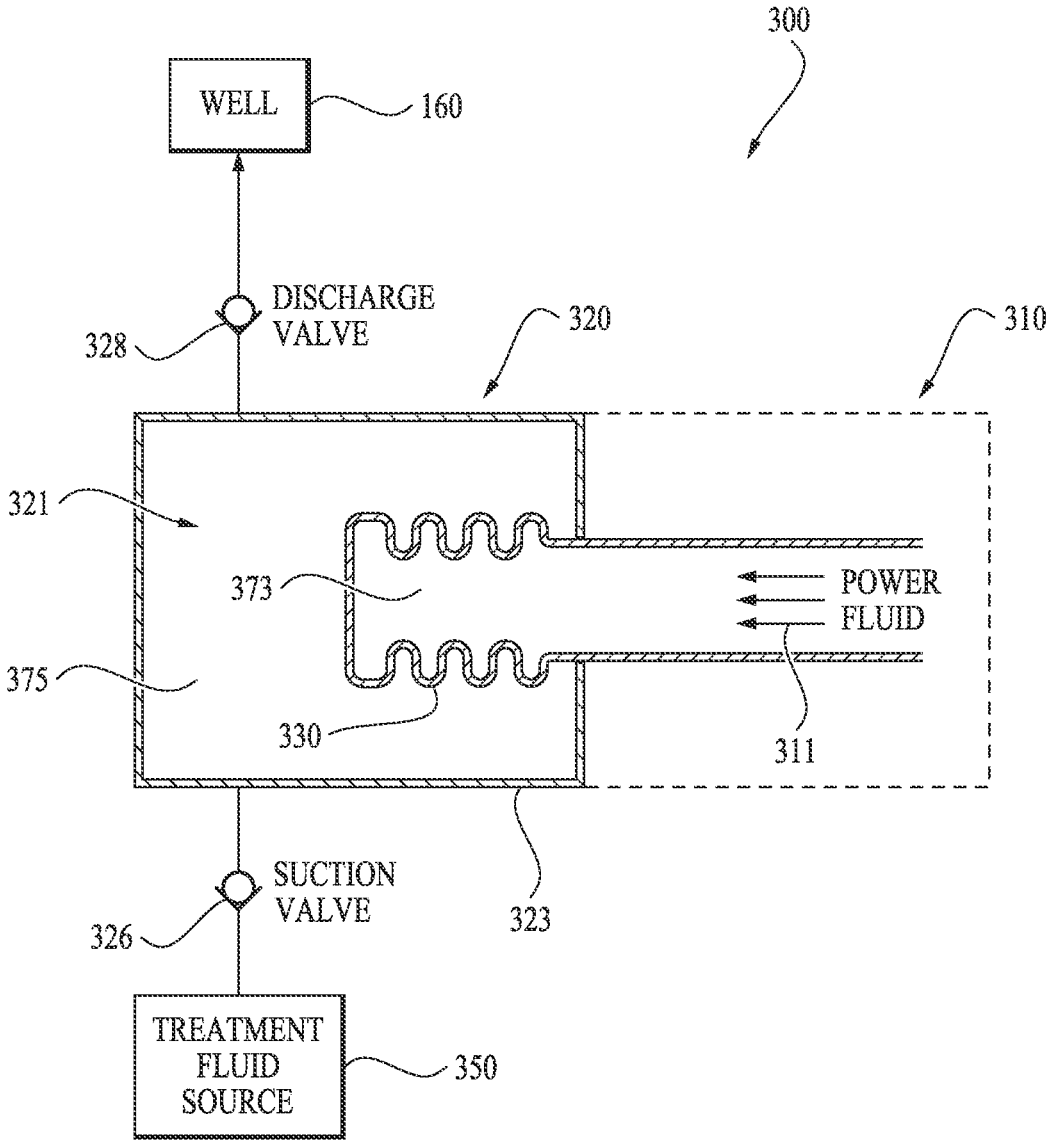
FIG. 3 is a schematic illustration of an exemplary bellows pump, according to an embodiment of the disclosure.

In FIG. 7, the bellows 330 is coupled to the fluid end housing 323 such that it defines the first volume 373 and the second volume 375 (e.g. as shown in FIG. 3, the bellows 330 is fluidly coupled to the fluid end bore 720 and/or the power end bore 420, and acts to separate the drive fluid therein from the treatment fluid in the chamber 321). In other words, the bellows 330 is structured to hermetically seal the first opening of the fluid end housing 323 (e.g. the opening configured to couple to the second portion 424 of the power end bore 420 and/or disposed in proximity to the face 708) from the remaining interior portions of the fluid end housing 323 (e.g. the chamber 321). The bellows 330 is structured and formed such that the bellows 330 is movable (e.g., extendable/expandable) and allows for the remaining interior portion of the fluid end housing 323 (e.g. the open portion of the chamber 321 outside the bellows 330, configured to receive treatment fluid) to grow in volume and shrink in volume depending upon the volume of the interior volume within the bellows 330. In embodiments, once the fluid end housing 323 is coupled to the power end housing 413, the bellows 330 may separate/segregate fluid in the power end bore 420 from the chamber 321, serving as a barrier therebetween.

In embodiments, the pump system 300 may also include a suction valve 326 having a first side connected to the remaining interior portion of the fluid end housing 323 (e.g. the chamber 321) and a discharge valve 328 having a first side connected to the remaining interior portion of the fluid end housing 323 (e.g. the chamber 321). A second side of the suction valve 326 may be coupled to a reservoir of treatment fluid (e.g., the fluid intended to be pumped). A second side of the discharge valve 328 may be connected to any place in which the treatment fluid is intended to be pumped to. For example, the second side of the discharge valve 328 may be fluidly coupled to an oil and gas fracturing well.

In various embodiments, the make-up port 515 (or additional make-up ports 515) may be positioned such as to allow for a fluid connection between an exterior of the housing and the interior volume (e.g. the inside of the bellows 330). In some embodiments, the make-up port 515 can be used to selectively introduce or remove fluid from the interior volume (e.g. within the bellows 330) to manage the axial position of piston element 410 relative to bellows 330 of the fluid end 320. Properly synchronizing the piston element 410 and the respective bellows 330 in the fluid end 320 can be important to operation of the system. A valving and control system may be used to manage the volume inside the interior volume (e.g. the bellows 330), which in turn controls the axial relationship of piston element 410 and the bellows 330.

For example, after the power end 310 is directly mechanically coupled to the fluid end 320, when piston element 410 is fully extended toward fluid end 320, bellows 330 is fully expanded and displacing most of a treatment fluid from the interior of fluid end housing 323 (e.g. from the chamber 321). And when piston element 410 is fully retracted away from the bellows 330, bellows 330 is displacing the least amount of treatment fluid inside the chamber 321 of the fluid end 320 (e.g. with the bellows 330 at its fully contracted state). The hydraulic reciprocation of piston element 410 causes corresponding reciprocation of bellows 330 inside the chamber 321 of the fluid end 320. In FIG. 7, during the retraction of piston element 410 (e.g. away from the fluid end 320), while make-up port 515 is blocked/closed, treatment fluid is drawn into the fluid end 320 through a suction valve 326 and valve port 775, and this may be referred to as a suction stroke. During the extension of piston element 410 toward the fluid end 320, while make-up port 515 is blocked/closed, treatment fluid is pushed out of the fluid end 320 through valve port 775 and discharge valve 328, and this may be referred to as a discharge stroke.

In the depicted embodiment, the fluid end housing 323 and power end housing 413 are shown to be joined with fasteners. Fasteners may include be screws, bolts, clamps, etc. The connection may also include a sealing element to contain the fluid in interior volume. Alternatively, in some embodiments, the fluid end housing 323 and power end housing 413 can also be made from a single piece of material such that they are a mono-block and do not require being fastened together.

In some embodiments, multiple pump systems can be joined together to form a larger multi-cylinder pumping system. For example, in some embodiments, the power end housing may be formed to include multiple-cylinder systems that may be formed of a single mono-block of material. That is, in some embodiments, the power end housing may have multiple piston elements disposed within respective cylinders of the power end housing that have corresponding fluid ends directly connected to the respective opening or channel driven by the respective piston element.

FIG. 10 is a two-dimension cross-sectional diagram illustrating an example of a pump, according to one or more aspects of the present disclosure. More particularly, FIG. 10 is a cross-sectional diagram of a pump 300 with a mounting arrangement between a power end 310 (e.g. pressure intensifier) and a fluid end 320. For example, the power end 310 and the fluid end 320 may be joined at a 90 degree angle. While the axial relationship between the piston element 410 and the bellows 330 in FIG. 7 was along the same (e.g., parallel) axis, in FIG. 10 the arrangement is such that the axial relationship between the piston element 410 and the bellows 330 still exists, but the respective axes are 90 degrees relative to one another. In other examples, the power end 310 and the fluid end 320 (e.g. the power end bore 420 and the bellows 330) may be arranged in any angle and fluidly connected via interior volume. In an embodiment, the power end 310 and a fluid end 320 may be joined near 90 degrees. In various embodiments, the power end 310 and fluid end 320 may be joined at other angles to accommodate system packaging envelope requirements. The system shown in FIG. 10 may function in similar manner as that of FIG. 7. The fluid end housing 323 of FIG. 10 is functionally similar to that of FIG. 7, however, with a different design of the face end and first opening and/or shape of the fluid end bore 720 to allow for the direct connection between the power end housing 413 and the fluid end housing 323. For example, such a configuration may provide for a particularly shaped or packaged pump, while also providing the benefits of the direct connections described above.

FIG. 11 is a two-dimension cross-sectional diagram illustrating an example of a pump, according to one or more aspects of the present disclosure. The pump in FIG. 11 may be similar to the pump in FIG. 7 and may be operationally similar. However, FIG. 11 includes a fluid end with a modified fluid end housing 323. In particular, the fluid end housing 323 of FIG. 11 includes the suction valve 326 and the discharge valve 328 disposed within respective openings within the fluid end housing 323. In such an embodiment, the suction valve 326 and discharge valve 328 may be packaged directly as part of the housing system (e.g., mechanically secured to the fluid end housing 323 during manufacturing), which may further reduce the need for external components and/or piping that may fatigue due to the intensity of pressure. In some embodiments, the suction valve 326 and the discharge valve 328 may be included in the fluid end housing 323 during manufacturing. In various embodiments, the respective openings within the fluid end housing 323 may be designed to mechanically secure respective valves 326 or 328 therein. In this embodiment, the valves may be replaced more easily while also providing the advantages described herein.

FIG. 12 is a two-dimension cross-sectional diagram illustrating an example of a pump 300, according to one or more aspects of the present disclosure. The pump 300 in FIG. 12 may be similar to the pumps in FIG. 10 and FIG. 11, respectively, and may be operationally similar to them. For example, in this embodiment, the pump 300 may include a fluid end housing 323 that is arranged at a 90 degree angle similar to that described with reference to FIG. 10, and also includes the respective openings for housing the suction valve 326 and the discharge valve 328 as part of the fluid end housing 323 similar to that of FIG. 11. In various embodiments, the openings along with the respective valves 326 and 328 may be positioned on other locations within the fluid end housing 323, for example depending upon the envelope and application needed for the pumps intended application.

FIG. 14 is a two-dimension cross-sectional diagram illustrating an example of a pump, according to one or more aspects of the present disclosure. FIG. 14 shows a double-acting pump system (e.g. dual bellows pump). In FIG. 14, two fluid ends 320*a*, 320*b* may be fluidly coupled and directly mechanically coupled to a single power end 310, with the piston 410 of the power end 310 being configured to reciprocate the bellows 330*a*, 330*b* in both fluid ends. Each fluid end may be similar to those described with regard to FIGS. 7-13 and may function in similar manner, as may the power end.

The pump system of FIG. 14 may include a power end housing 413 that includes the first opening. In this embodiment, the power end housing 413 may also include a second opening (e.g. the power end 413 comprises a larger first portion 422 of the power end bore 420 (configured for movement of the head 412 of the piston 410) and two smaller diameter second portions 424 of the power end bore 420 (e.g. configured for movement of corresponding piston rods 414*a*, 414*b* therein)). The power end housing 413 may include a first face (similar to the face 707) and a second face (similar to the face 707) corresponding to the respective first and second openings. The first opening (e.g. the is fluidly coupled to a first fluid end 320*a* via a direct mechanical connection between the power end housing 413 and a first fluid end housing 323*a*. The second opening is fluidly coupled to a second fluid end 320*b* via a direct mechanical connection between the power end housing 413 and a second fluid end housing 323*b*. In this example, the first fluid end 320*a* includes a first bellow 330*a* that defines a first internal volume and the second fluid end 320*b* includes a second bellow 330*b* that defines a second internal volume. The first and second fluid ends 320*a* and 320*b* may be similar to the fluid end described with reference to FIG. 7, and the mechanical connections may be similar to those described with reference to FIG. 7.

In this example, the second opening can also extend from an exterior of the power end housing 413 to form a second channel in the power end housing 413 (e.g. a second portion 424 of the power end bore 420 configured for fluid connection with the second fluid end 320*b*). The piston element 410 may include a first rod portion 414*a* and a second rod portion 414*b*. In an embodiment, the first and second rod portions 414*a*, 414*b* can extend from a head portion 412 in opposite directions along the same or parallel axes. The first and second rod portions 414*a*, 414*b* may extend into the respective first and second channels (e.g. second portion 424 of the power end bore 420) within the power end housing 413 and may involve second seals (e.g. 453*a*, 453*b*) like as described with reference to FIG. 7.

A first port 432 and a second port 434 are used to drive piston element 410 in a reciprocating manner. In this double-acting case, a driving area of the piston element 410 is defined as being that bounded by the piston head 412 diameter and the first and second rod portion 414*a*, 414*b* diameters. In various embodiments, the driving area is larger than the rod end area (e.g., the cross-sectional area's of the respective rod portion ends) in order to provide pressure intensification. The area ratio may range from 1.1:1 and 10:1.

FIG. 15 is a two-dimension cross-sectional diagram illustrating an example of a pump, according to one or more aspects of the present disclosure. FIG. 15 depicts an alternative configuration for a double-acting (e.g. dual bellows) pump system. In this configuration the fluid ends 320*a*, 320*b* may be mounted at approximately 90 degrees to the power end and fluidly communicate through corresponding second portions 424 of the power end bore 410 and fluid end bores 720*a*, 720*b*, respectively. The system may have suction and discharge valves integrated into the fluid end housings 323*a*, 323*b*, respectively, and may function similar to the fluid ends described with reference to FIG. 12.

Disclosed embodiments also comprise exemplary methods for pumping treatment fluid into a well. Such methods may use any of the disclosed pump or system embodiments, such as the examples illustrated in FIGS. 7-16. For example, an exemplary method embodiment may comprise: providing a power end having a piston disposed in a power end bore; providing a (e.g. separate) fluid end having a fluid end bore and a chamber; and fluidly coupling the power end and the fluid end (e.g. the power end bore and the fluid end bore) without external piping therebetween, without unswept volume therebetween, and/or forming a continuous, unbroken, and/or unitary pump bore (which may consist essentially of the power end bore and the fluid end bore and/or may be entirely disposed within the power end housing and the fluid end housing), thereby forming a bellows pump which may be used to pump treatment fluid. Some embodiments may further comprise pumping treatment fluid into the well using the bellows pump (e.g. with treatment fluid moving through the chamber of the fluid end to the well due to movement of the bellows within the chamber).

In some embodiments, the power end may further comprise a power end housing (e.g. with the power end bore disposed therein), the fluid end may further comprise a fluid end housing (e.g. with the chamber and the fluid end bore disposed therein), and fluidly coupling the power end to the fluid end may comprise mating (e.g. physically contacting/bringing into direct physical contact/abutting) the power end housing and the fluid end housing (e.g. the corresponding faces of the power and fluid end housings) and physically coupling the power end housing and the fluid end housing (e.g. the corresponding faces of the power and fluid end housings) together (e.g. to form a unitary body, with no external piping therebetween). Some embodiments may further comprise sealing a joint between the power end housing and the fluid end housing (e.g. between the corresponding faces of the power and fluid end housings). For example, sealing may comprise disposing a housing seal between the corresponding faces of the power and fluid end housings, which is configured to seal the joint therebetween when the housings are coupled together.

Some embodiments may further comprise providing a make-up port in the fluid end, and providing a second seal in the fluid end bore (e.g. wherein the second seal is configured to allow sealing movement of the rod of the piston within the fluid end bore). In embodiments, the make-up port may be disposed between the second seal and the bellows. Some method embodiments may further comprise pumping treatment fluid (e.g. through the chamber, based on reciprocal movement of the piston with respect to the bellows), wherein the sealed joint between the power end housing and the fluid end housing (e.g. the housing seal) is not exposed to high pressure of the bellows (e.g. wherein the second seal shields the housing seal from the high pressure in the bellows, such that the housing seal is only exposed to the lower pressure applied to a head of the piston). Alternate embodiments may comprise providing a make-up port in the fluid end, and providing a second seal at or proximate to the sealed joint (e.g. the housing seal). For example, the second seal may be disposed at the joint between the power end housing and the fluid end housing. Some embodiments may further comprise performing maintenance (e.g. after pumping treatment fluid) by uncoupling the power end housing from the fluid end housing and inspecting and/or replacing the second seal and/or the housing seal. For example, the seals may be readily accessible for maintenance (e.g. based on specific configuration).

Some method embodiments comprise orienting the bellows to expand downwards (e.g. with respect to gravity). For example, in some embodiments orienting the bellows may be accomplished by orienting the pump (e.g. so that the bellows is configured to expand downward) and/or by orienting the fluid end or a portion of the fluid end bore (e.g. so that it is angled with respect to the power end). Some embodiments may further comprise disposing the chamber/fluid end so that the fluid connection to the suction and discharge valves is located below the bellows (e.g. with respect to gravity). For example, this may entail disposing the fluid end so that the suction valve and the discharge valve are below (e.g. with respect to gravity) the bellows, and/or disposing the suction and discharge valves to be located below the bellows.

One or more of the pump embodiments disclosed herein (e.g. relating to FIGS. 7-16) may be used to implement any of the disclosed method embodiments and/or may be involved in any of the disclosed method embodiments. For example, a programmable storage device can have program instructions stored thereon configured to cause a processor (e.g. of the control system of the bellows pump system) to perform any of the disclosed method embodiments or aspects thereof, and/or a non-transitory computer-readable medium can have program instructions stored thereon configured to cause a control system (e.g. of the bellows pump system) to perform any of the disclosed method embodiments or aspects thereof. Such instructions may be used by the control system of the disclosed bellows pump system embodiments, for example to operate the bellows pump system (which may include disclosed pump embodiments).

Additional Disclosure

The following are non-limiting, specific embodiments in accordance with the present disclosure:

In a first embodiment, a pump for introducing treatment fluid into a well comprises: a power end having a piston disposed in a power end bore; a fluid end having a fluid end bore and a chamber in fluid communication with a suction valve and a discharge valve; and an expandable bellows disposed in the chamber and in fluid communication with the fluid end bore and/or the power end bore; wherein the power end is configured to reciprocally expand and contract the bellows within the chamber based on movement of fluid by the piston, and wherein the power end bore and the fluid end bore are fluidly coupled (e.g. in fluid communication) to form a unitary, continuous, and/or unbroken pump bore without external piping therebetween and/or without unswept volume therebetween (e.g. minimizing unswept volume between the piston and the bellows).

A second embodiment can include the pump of the first embodiment, wherein the bellows is in fluid communication with the power end bore through the fluid end bore.

A third embodiment can include the pump of the first or second embodiment, wherein a discharge stroke of the piston expands the bellows within the chamber (e.g. thereby driving treatment fluid in the chamber out through the discharge valve) and a suction stroke of the piston contracts the bellows within the chamber (e.g. thereby introducing treatment fluid into the chamber through the suction valve).

A fourth embodiment can include the pump of any one of the first to fourth embodiments, wherein the power end further comprises a power end housing (e.g. with the power end bore disposed therein), the fluid end further comprises a fluid end housing (e.g. with the chamber and fluid end bore disposed therein), the power end housing and the fluid end housing are configured to be directly (e.g. mechanically) coupled together (e.g. with no piping and/or unswept volume therebetween), and the unitary, continuous, and/or unbroken pump bore is entirely disposed within the power end housing and the fluid end housing (e.g. due to direct contact of the power end housing to the fluid end housing).

A fifth embodiment can include the pump of any one of the first to fourth embodiments, wherein the pump bore consists essentially of the power end bore and the fluid end bore, for example contacting with open ends aligning, and/or wherein the pump housing consists essentially of the power end housing and the fluid end housing.

A sixth embodiment can include the pump of the fifth embodiment, wherein the contacting open ends of the power end bore and the fluid end bore have approximately the same diameter/cross-section.

A seventh embodiment can include the pump of any one of the fourth to sixth embodiments, wherein the power end housing and the fluid end housing each have corresponding faces (e.g. flanges) configured for physical coupling of the power end housing directly to the fluid end housing.

An eighth embodiment can include the pump of the seventh embodiment, wherein the corresponding faces are configured for mechanical coupling (e.g. configured to be bolted together).

A ninth embodiment can include the pump of any one of the seventh to eighth embodiments, wherein the corresponding faces are configured for parallel mating contact.

A tenth embodiment can include the pump of any one of the fourth to ninth embodiments, further comprising a housing (e.g. joint) seal disposed between the power end housing and the fluid end housing (e.g. between the corresponding faces) (e.g. configured to seal the joint therebetween).

An eleventh embodiment can include the pump of the tenth embodiment, wherein the housing seal is configured to seal the fluid connection/coupling between the power end bore and the fluid end bore to form the unitary sealed pump bore (e.g. preventing leakage from escaping at the joint between the housings).

A twelfth embodiment can include the pump of any one of the first to eleventh embodiments, wherein the power end bore and the fluid end bore have contacting open ends aligning (e.g. when the corresponding faces are coupled in contact).

A thirteenth embodiment can include the pump of any one of the first to twelfth embodiments, wherein the power end bore and the fluid end bore align (e.g. have longitudinal centerlines aligned).

A fourteenth embodiment can include the pump of any one of the first to thirteenth embodiments, wherein the bellows is configured to extend parallel to the power end bore and/or fluid end bore (e.g. the bellows has a longitudinal centerline which aligns with the longitudinal centerlines of the power end bore and the fluid end bore).

A fifteenth embodiment can include the pump of any one of the first to fourteenth embodiments, wherein the power end further comprises two drive ports (e.g. a first port and a second port), for example with the first port configured to inject fluid in order to drive the piston towards the bellows (e.g. towards the fluid end bore), and the second port configured to inject fluid in order to drive the piston away from the bellows (e.g. away from the fluid end bore)—wherein the first port 432 is in fluid communication with the first cavity of the bore, and the second port 434 is in fluid communication with the second cavity of the bore.

A sixteenth embodiment can include the pump of the fifteenth embodiment, further comprising a hydraulic circuit fluidly coupled to the two drive ports (e.g. the first port and the second port) (and configured to inject and remove fluid therethrough to drive the piston, providing reciprocal movement of the piston).

A seventeenth embodiment can include the pump of any one of the first to sixteenth embodiments, wherein the piston further comprises a head and a rod, wherein the rod extends away from the head towards the bellows (e.g. fluid end).

An eighteenth embodiment can include the pump of the seventeenth embodiment, wherein the head is disposed between the first port and the fluid end, and the second port is disposed between the head and the fluid end.

A nineteenth embodiment can include the pump of any one of the seventeenth to eighteenth embodiments, further comprising a first seal (e.g. a moving seal/the piston head seal—e.g. disposed on the head) configured to allow the head to sealingly move (e.g. reciprocate) within the bore, and a second seal (e.g. a stationary seal/packing/piston rod seal—e.g. disposed in either the power end bore or the fluid end bore) configured to allow the rod to sealingly move (e.g. reciprocate) within the bore.

A twentieth embodiment can include the pump of any one of the seventeenth to nineteenth embodiments, wherein the bore comprises a first portion configured for movement of the head (e.g. axially) therethrough (e.g. having a diameter sized for the head) and a second portion configured for movement of the rod (e.g. axially) therethrough (e.g. having a diameter sized for the rod) (e.g. the first portion is wider than the second portion).

A twenty-first embodiment can include the pump of any one of the seventeenth to twentieth embodiments, wherein the head has a larger diameter/cross-section than the rod (e.g. wherein the piston is part of an intensifier—wherein the rod to head size ranges from 1:1.1 to 1:10, for example) (wherein the power end is part of, comprises, is configured as, or consists essentially of an intensifier).

A twenty-second embodiment can include the pump of any one of the first to twenty-first embodiments, wherein the chamber/fluid end housing further comprises a valve port configured to be in fluid communication with both the suction valve and the discharge valve (e.g. providing fluid communication between the suction and discharge valves and the chamber).

A twenty-third embodiment can include the pump of any one of the first to twenty-second embodiments, further comprising a make-up port in fluid communication with the power end bore and/or the fluid end bore (e.g. and configured to be fluidly coupled to a make-up system configured to keep the piston and bellows in sync and/or to maintain a controlled volume of fluid between the piston (e.g. rod) and the bellows (e.g. in the third cavity of the bore)—by allowing for injection of fluid into or removal of fluid from between the piston rod and the bellows) (and extending (e.g. radially) from the bore to the exterior of the housing), wherein the make-up port is disposed between the second seal and the bellows (e.g. in either the power end bore or the fluid end bore).

A twenty-fourth embodiment can include the pump of the twenty-third embodiment, wherein the make-up port is disposed between the second seal and the bellows.

A twenty-fifth embodiment can include the pump of any one of the twenty-third to twenty-fourth embodiments, wherein the make-up port is disposed in the power end (e.g. in fluid communication with the power end bore).

A twenty-sixth embodiment can include the pump of any one of the twenty-third to twenty-fourth embodiments, wherein the make-up port is disposed in the fluid end (e.g. in fluid communication with the fluid end bore).

A twenty-seventh embodiment can include the pump of the twenty-sixth embodiment, wherein the second seal is disposed in the fluid end (e.g. in the fluid end bore between the make-up port and the face of the fluid end/joint between the fluid end housing and the power end housing/housing seal) (with the make-up port disposed between the second seal and the bellows).

A twenty-eighth embodiment can include the pump of the twenty-sixth embodiment, wherein the second seal is a moving seal disposed on the rod of the piston.

A twenty-ninth embodiment can include the pump of any one of the twenty-seventh to twenty-eighth embodiments, wherein the housing seal is shielded from high pressure (e.g. within the bellows) by the second seal (such that the housing seal is only exposed to the lower pressure from the first portion of the bore, and not exposed to the higher pressure of the bellows).

A thirtieth embodiment can include the pump of any one of the twenty-third to twenty-fourth embodiments, wherein the second seal is disposed proximate to (e.g. axially aligned with) the housing seal (e.g. at the face/joint).

A thirty-first embodiment can include the pump of any one of the twenty-third to twenty-fourth embodiments, wherein the housing seal and the second seal are jointly formed (e.g. jointly form a unitary seal configured for both functions).

A thirty-second embodiment can include the pump of any one of the first to thirty-first embodiments, wherein the fluid end bore includes an angled portion (which could in some embodiments be the entire fluid end bore), which is in fluid communication with the power end bore but not aligned with the power end bore (e.g. extends in a direction angled from the longitudinal centerline axis of the power end bore—with the longitudinal centerline axis of the angled portion of the fluid end bore extending at an angle from (e.g. not parallel to) the longitudinal centerline axis of the power end bore)—such that the bellows expands in a direction angled from the power end bore (e.g. from the longitudinal centerline axis of the power end bore).

A thirty-third embodiment can include the pump of any one of the first to thirty-first embodiments, wherein the bellows is configured to expand at an angle to the fluid end bore (e.g. angled from the longitudinal centerline axis of the fluid end bore) and/or the power end bore (e.g. angled from the longitudinal centerline axis of the power end bore).

A thirty-fourth embodiment can include the pump of any one of the thirty-second to thirty-third embodiments, wherein the angle (e.g. of the angled portion of the fluid end bore and/or bellows expansion) is approximately 90 degrees (e.g. orthogonal and/or perpendicular to) the power end bore (e.g. the longitudinal centerline of the power end bore).

A thirty-fifth embodiment can include the pump of any one of the first to thirty-fourth embodiment, wherein the bellows is configured to expand downward (e.g. with respect to gravity).

A thirty-sixth embodiment can include the pump of any one of the first to thirty-fifth embodiments, wherein the suction valve and the discharge valve are integrated into the fluid end housing (e.g. wherein the fluid end housing further comprises two valve ports in fluid communication with the chamber, and wherein the suction valve and discharge valve are disposed therein).

A thirty-seventh embodiment can include the pump of any one of the first to thirty-sixth embodiments, wherein the suction valve is disposed opposite the discharge valve in the chamber (e.g. the valve ports are disposed on opposite sides of the chamber).

A thirty-eighth embodiment can include the pump of any one of the first to thirty-sixth embodiments, wherein the suction valve and the discharge valve are disposed on the same side/face of the chamber/fluid end housing (e.g. the valve ports are disposed on the same side of the chamber).

A thirty-ninth embodiment can include the pump of any one of the first to thirty-eighth embodiments, wherein the suction valve and the discharge valve are both disposed below (e.g. with respect to gravity) the bellows (e.g. wherein both valve ports are disposed below the bellows) (e.g. so that as the bellows extends during a discharge stroke, it extends downward towards the suction and discharge valve).

A fortieth embodiment can include the pump of any one of the first to thirty-ninth embodiments, wherein fluid communication between the suction and discharge valves and the chamber (e.g. the one or more valve port) is disposed below (e.g. with respect to gravity) the bellows.

A forty-first embodiment can include the pump of any one of the first to fortieth embodiments, wherein the piston (e.g. the rod) is configured to only extend in the power end bore (e.g. with the second seal disposed in the power end bore) (e.g. the rod does not extend into the fluid end bore, even on the discharge stroke).

A forty-second embodiment can include the pump of any one of the first to fortieth embodiments, wherein the piston extends through both the power end bore and the fluid end bore (e.g. the rod is configured to extend into the fluid end bore (e.g. at least during the discharge stroke).

A forty-third embodiment can include the pump of the forty-second embodiment, wherein a distal end of the rod (e.g. the end of the rod closest to the bellows) is configured to remain in the fluid end bore throughout reciprocal movement of the piston (e.g. during both discharge and suction strokes) (e.g. never exits/retracts out of the fluid end bore).

A forty-fourth embodiment can include the pump of any one of the first to forty-third embodiments, wherein the second seal is disposed in the fluid end bore.

A forty-fifth embodiment can include the pump of any one of the first to forty-fourth embodiments, wherein the distal end of the rod does not extend into the bellows (e.g. on discharge stroke).

A forty-sixth embodiment can include the pump of any one of the first to forty-fifth embodiments, wherein the distal end of the rod partially extends into the bellows (e.g. extends into the bellows during the discharge stroke, but does not contact a distal end of the bellows (e.g. the end of the bellows extending furthest into the chamber and/or away from the rod)) (wherein the controlled volume of fluid is configured to prevent the distal end of the rod from contacting the distal end of the bellows).

A forty-seventh embodiment can include the pump of any one of the first to forty-sixth embodiments, further comprising a second fluid end having a second fluid end bore and a second chamber (e.g. both in the second fluid end housing) in fluid communication with a second suction valve and a second discharge valve (e.g. the second fluid end may be substantially the same as the first fluid end), and a second expandable bellows, wherein the power end bore is fluidly coupled (e.g. in fluid communication) to both the first and second fluid end bores to form a unitary pump bore without external piping therebetween and/or entirely located within the power end housing and the two fluid end housings due to direct contact of the housings and/or consisting essentially of the power end bore and the two fluid end bores and/or without unswept volume therebetween (e.g. minimizing unswept volume between the piston and the bellows), and wherein the power end is configured to reciprocally expand and contract both the first and second bellows based on movement of fluid by the piston.

A forty-eight embodiment can include the pump of the forty-seventh embodiment, wherein the piston comprises a head and two rods, wherein the rods extend from opposite sides of the head (e.g. with the first rod extending towards the first fluid end/bellows and the second rod extending towards the second fluid end/bellows).

A forty-ninth embodiment can include the pump of any one of the forty-seventh to forty-eighth embodiments, further comprising a second housing (e.g. joint) seal disposed between the power end housing and the second fluid end housing (e.g. wherein the pump has two housing seals, with a housing seal disposed between the power end housing and each of the two fluid end housings).

A fiftieth embodiment can include the pump of the forty-ninth embodiment, wherein the second housing seal is configured to seal the joint between the power end housing and the second fluid end housing.

A fifty-first embodiment can include the pump of any one of the forty-ninth to fiftieth embodiments, wherein the second housing seal is configured to seal the fluid connection/coupling between the power end bore and the second fluid end bore (e.g. preventing leakage from escaping at the joint between the housings).

A fifty-second embodiment can include the pump of any one of the forty-seventh to fifty-first embodiments, wherein one or both of the first and second fluid end bore includes an angled portion (which could in some embodiments be the entire fluid end bore), which is in fluid communication with the power end bore but not aligned with the power end bore (e.g. extends in a direction angled from the longitudinal centerline axis of the power end bore—with the longitudinal centerline axis of the angled portion of the fluid end bore extending at an angle from (e.g. not parallel to) the longitudinal centerline axis of the power end bore) (e.g. such that the corresponding one or more bellows expand in a direction angled from the power end bore (e.g. from the longitudinal centerline axis of the power end bore)).

A fifty-third embodiment can include the pump of any one of the first to fifty-second embodiments, wherein the power end bore and the fluid end bore are fluidly coupled without external piping therebetween by the power end bore and the fluid end bore contacting (e.g. with open ends aligning) to form the continuous, unbroken, and/or unitary pump bore (which consists essentially of the power end bore and the fluid end bore).

A fifty-fourth embodiment can include the pump of any one of the first to fifty-third embodiments, wherein the power end and the fluid end(s) are both disposed within a common housing (e.g. within a unitary housing, which may be machined from a single piece of metal) (e.g. the power end housing and the fluid end housing are both portions of the unitary/common housing).

In a fifty-fifth embodiment, a method for pumping treatment fluid into a well comprises: providing a power end having a piston disposed in a power end bore; providing a (e.g. separate) fluid end having a fluid end bore and a chamber (e.g. in fluid communication with a suction valve and a discharge valve); and fluidly coupling the power end and the fluid end (e.g. the power end bore and the fluid end bore) without external piping therebetween and/or without unswept volume therebetween and/or forming a continuous, unbroken, and/or unitary pump bore (e.g. which consists essentially of the power end bore and the fluid end bore) (e.g. to form a bellows pump).

A fifty-sixth embodiment can include the method of the fifty-fifth embodiment, further comprising pumping treatment fluid into the well using the bellows pump (e.g. with treatment fluid moving through the chamber to the well due to movement of the bellows within the chamber).

A fifty-seventh embodiment can include the method of the fifty-sixth embodiment, further comprising fluidly coupling the chamber of the pump (e.g. the suction valve) to a source for treatment fluid.

A fifty-eight embodiment can include the method of any one of the fifty-fifth to fifty-seventh embodiments, wherein the power end further comprises a power end housing (e.g. with the power end bore disposed therein), wherein the fluid end further comprises a fluid end housing (e.g. with the chamber and the fluid end bore disposed therein), and wherein fluidly coupling comprises mating (e.g. physically contacting/bringing into direct physical contact) the power end housing and the fluid end housing (e.g. the corresponding faces of the power and fluid end housings) and physically coupling the power end housing and the fluid end housing (e.g. the corresponding faces of the power and fluid end housings) together (to form a unitary body—with no external piping therebetween).

A fifty-ninth embodiment can include the method of the fifty-eight embodiment, further comprising sealing a joint between the power end housing and the fluid end housing (e.g. between the corresponding faces of the power and fluid end housings)—disposing a housing seal between the corresponding faces of the power and fluid end housings, which is configured to seal the joint therebetween when the housings are coupled together.

A sixtieth embodiment can include the method of the fifty-ninth embodiment, further comprising providing a make-up port in the fluid end, and providing a second seal in the fluid end bore (e.g. wherein the second seal is configured to allow sealing movement of the rod within the fluid end bore), wherein the make-up port is disposed between the second seal and the bellows.

A sixty-first embodiment can include the method of the sixtieth embodiment, further comprising pumping treatment fluid (e.g. through the chamber, based on reciprocal movement of the piston with respect to the bellows), wherein the sealed joint (e.g. the housing seal) is not exposed to high pressure of the bellows (e.g. wherein the second seal shields the housing seal from the high pressure in the bellows, such that the housing seal is only exposed to the lower pressure applied to a head of the piston).

A sixty-second embodiment can include the method of the fifty-ninth embodiment, further comprising providing a make-up port in the fluid end; and providing a second seal at or proximate to the sealed joint (e.g. the housing seal) (e.g. disposed at the joint between the power end housing and the fluid end housing).

A sixty-third embodiment can include the method of the sixty-second embodiment, further comprising performing maintenance (e.g. after pumping treatment fluid) by uncoupling the power end housing from the fluid end housing and inspecting and/or replacing the second seal and/or the housing seal (wherein the seals are readily accessible for maintenance).

A sixty-fourth embodiment can include the method of any one of the fifty-fifth to sixty-third embodiments, further comprising orienting the bellows to expand downwards (e.g. with respect to gravity) (e.g. by orienting the pump and/or the fluid end).

A sixty-fifth embodiment can include the method of any one of the fifty-fifth to sixty-fourth embodiments, further comprising disposing the chamber so that the fluid connection to the suction and discharge valves is located below the bellows (with respect to gravity) (e.g. disposing the fluid end so that the suction valve and the discharge valve are below (e.g. with respect to gravity) the bellows).

A sixty-sixth embodiment can include the method of any one of the fifty-fifth to sixty-fifth embodiments, wherein the pump comprises any one of the first to fifty-fourth pump embodiments.

A sixty-seventh embodiment can include the pump of any one of the first to fifty-fourth embodiments, configured to carry out the method of any one of the fifty-fifth to sixty-fifth embodiments.

In a sixty-eighth embodiment, a programmable storage device having program instructions stored thereon for causing a processor to perform the method according to any one of the fifty-fifth to sixty-fifth embodiments and/or for being used by the pump of any one of the first to fifty-fourth embodiments.

In an eightieth embodiment, a non-transitory computer-readable medium having program instructions stored thereon for causing a control system to perform the method of any one of the fifty-fifth to sixty-fifth embodiments and/or for being used by the pump of any one of the first to fifty-fourth embodiments.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein, unless otherwise specifically noted herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

It should similarly be understood that terms such as "hot," "cold," "hotter," "cooler," "colder," and other such temperature terms are relative terms and do not denote any specific temperature. Rather, reference to a hot fluid means that the fluid is hotter than a cool fluid of the system and/or has been heated, while reference to a cool fluid means a fluid that is cooler/colder than a hot fluid of the system and/or has not been heated or has been heated less than the fluid of another portion of the system (for example another portion of the system with which the fluid is interacting).

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A pump for introducing treatment fluid into a well, comprising:

a power end having a piston disposed in a power end bore;

a fluid end having a fluid end bore and a chamber in fluid communication with a suction valve and a discharge valve; and an expandable bellows disposed in the chamber and in fluid communication with the fluid end bore;

wherein the power end is configured to reciprocally expand and contract the bellows within the chamber based on movement of fluid by the piston, wherein the power end bore and the fluid end bore are fluidly coupled to form a continuous pump bore without external piping therebetween, and wherein:

the power end further comprises a power end housing, with the power end bore disposed in the power end housing, the fluid end further comprises a fluid end housing, with the fluid end bore disposed in the fluid end housing, the power end housing and the fluid end housing are configured to be directly coupled together, and the continuous pump bore is entirely disposed within the power end housing and the fluid end housing.

2. The pump of claim 1, further comprising a housing seal disposed between the power end housing and the fluid end housing, wherein the housing seal is configured to seal fluid coupling between the power end bore and the fluid end bore.

3. The pump of claim 2, wherein the piston further comprises a head and a rod, wherein the rod extends away from the head towards the bellows, the pump further comprising: a first seal configured to allow the head to sealingly move within the pump bore; a second seal configured to allow the rod to sealingly move within the pump bore; and a make-up port in fluid communication with the power end bore or the fluid end bore, wherein the make-up port is disposed between the second seal and the bellows.

4. The pump of claim 3, wherein the make-up port is disposed in the fluid end and in fluid communication with the fluid end bore.

5. A pump for introducing treatment fluid into a well, comprising:

a power end having a power end housing and a piston disposed in a power end bore;

a fluid end having a fluid end housing, a fluid end bore, and a chamber in fluid communication with a suction valve and a discharge valve;

an expandable bellows disposed in the chamber and in fluid communication with the fluid end bore; and a housing seal disposed between the power end housing and the fluid end housing, wherein the housing seal is configured to seal fluid coupling between the power end bore and the fluid end bore;

wherein:

the power end is configured to reciprocally expand and contract the bellows within the chamber based on movement of fluid by the piston, and the power end bore and the fluid end bore are fluidly coupled to form a continuous pump bore without external piping therebetween, the power end housing and the fluid end housing are configured to be directly coupled together, the continuous pump bore is entirely disposed within the power end housing and the fluid end housing, the piston further comprises a head and a rod, wherein the rod extends away from the head towards the bellows, the pump further comprising: a first seal configured to allow the head to sealingly move within the pump bore; a second seal configured to allow the rod to sealingly move within the pump bore; and a make-up port in fluid communication with the power end bore or the fluid end bore, the make-up port is disposed between the second seal and the bellows, the make-up port is disposed in the fluid end and in fluid communication with the fluid end bore, and the second seal is disposed in the fluid end bore between the make-up port and the housing seal.

6. The pump of claim 5, wherein the housing seal is shielded from high pressure within the bellows by the second seal.

7. The pump of claim 4, wherein the second seal is disposed proximate to the housing seal.

8. The pump of claim 1, wherein the fluid end bore includes an angled portion, which is in fluid communication with the power end bore but not aligned with the power end bore.

9. The pump of claim 1, wherein the bellows is configured to expand downward, and wherein the chamber is configured so that fluid connection to the suction and discharge valves is located below the bellows.

10. The pump of claim 1 wherein the suction valve and the discharge valve are integrated into the fluid end housing, and wherein the suction valve and the discharge valve are disposed on a same side of the chamber.

11. The pump of claim 3, wherein the rod is configured to extend into the fluid end bore, and wherein a distal end of the rod is configured to remain in the fluid end bore throughout reciprocal movement of the piston.

12. The pump of claim 3, further comprising:

a second fluid end having a second fluid end housing with a second fluid end bore and a second chamber which is in fluid communication with a second suction valve and a second discharge valve; and a second expandable bellows;

wherein:

the power end bore is fluidly coupled to both the first and second fluid end bores to form the continuous pump bore consisting essentially of the power end bore and the two fluid end bores, the power end is configured to reciprocally expand and contract both the first and second bellows based on movement of fluid by the piston, the piston comprises a head and two rods, the rods extend from opposite sides of the head, and the pump further comprises a second housing seal disposed between the power end housing and the second fluid end housing.

13. The pump of claim 12, wherein one or both of the first and second fluid end bore includes an angled portion, which is in fluid communication with the power end bore but not aligned with the power end bore.

14. A method of pumping treatment fluid into a well using the pump of claim 1, comprising:

providing the power end;

providing the separate fluid end; and fluidly coupling the power end bore and the fluid end bore without external piping therebetween, forming the continuous pump bore which consists essentially of the power end bore and the fluid end bore.

15. The method of claim 14, wherein:

fluidly coupling comprises physically contacting and coupling the power end housing and the fluid end housing, and the continuous pump bore is entirely disposed within the coupled power end housing and fluid end housing.

16. The method of claim 15, further comprising disposing a housing seal between the power end housing and the fluid end housing, which is configured to seal a joint therebetween when the housings are coupled together.

17. A method of pumping treatment fluid into a well using a bellows pump, comprising:

providing a power end having a piston with a head and a rod disposed in a power end bore;

providing a separate fluid end having a fluid end bore and a chamber; and fluidly coupling the power end bore and the fluid end bore without external piping therebetween, forming a continuous pump bore which consists essentially of the power end bore and the fluid end bore;

wherein: the power end further comprises a power end housing, the fluid end further comprises a fluid end housing, fluidly coupling comprises physically contacting and coupling the power end housing and the fluid end housing, and the continuous pump bore is entirely disposed within the coupled power end housing and fluid end housing;

further comprising:

disposing a housing seal between the power end housing and the fluid end housing, which is configured to seal a joint therebetween when the housings are coupled together;

providing a make-up port in the fluid end;

providing a second seal in the fluid end bore, wherein the second seal is configured to allow sealing movement of the rod within the fluid end bore, and wherein the make-up port is disposed between the second seal and a bellows of the bellows pump; and pumping treatment fluid using the bellows pump, wherein the second seal shields the housing seal from high pressure in the bellows during pumping.

18. The method of claim 14, further comprising: orienting the bellows to expand downwards, and disposing the chamber so that fluid connection to the suction and discharge valves is located below the bellows.

19. The pump of claim 1, wherein the power end bore and the fluid end bore have identical diameters, and an open end of the fluid end bore aligns with an open end of the power end bore.

20. The pump of claim 19, wherein the piston is configured to extend into the fluid end bore during operation of the pump, but not to contact the bellows.

* * * * *